US006206497B1

(12) United States Patent
Miura et al.

(10) Patent No.: US 6,206,497 B1
(45) **Date of Patent: *Mar. 27, 2001**

(54) LIQUID EJECTING APPARATUS WITH VARIABLE WIPING OF A LIQUID EJECTION HEAD

(75) Inventors: Yasushi Miura; Mitsuru Kurata, both of Kawasaki; Toshiaki Mabuchi, Tama; Yasuyuki Takanaka, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/977,390

(22) Filed: Nov. 24, 1997

Related U.S. Application Data

(63) Continuation of application No. 08/301,419, filed on Sep. 9, 1994, now abandoned.

(30) Foreign Application Priority Data

Sep. 10, 1993 (JP) ..... 5-225917
Nov. 15, 1993 (JP) ..... 5-285360

(51) Int. Cl.[7] ..... B41J 2/165
(52) U.S. Cl. ..... 347/28
(58) Field of Search ..... 347/23, 28, 31–33, 347/22, 24; 15/256.1; 400/702.1

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |

(List continued on next page.)

FOREIGN PATENT DOCUMENTS

| | | | |
|---|---|---|---|
| 54-056847 | 5/1979 | (JP) . | |
| 59-83664 * | 5/1984 | (JP) | 347/28 |
| 59-123670 | 7/1984 | (JP) . | |
| 59-138461 | 7/1984 | (JP) . | |
| 60-071260 | 4/1985 | (JP) . | |
| 62-053492 | 3/1987 | (JP) . | |
| 63-130348 | 6/1988 | (JP) . | |
| 2-266949 | 10/1990 | (JP) | B41J/2/165 |
| 03046589 | 7/1991 | (JP) . | |
| 3-222754 | 10/1991 | (JP) . | |
| 4-344255 | 11/1992 | (JP) . | |
| 5-16391 | 1/1993 | (JP) . | |
| 06-79880 * | 3/1994 | (JP) | 347/30 |

OTHER PUBLICATIONS

"Summer dress you want to make," Jun. 10, 1987, published by Kabushiki Kaisha Yukeisha, and English translation thereof.

*Primary Examiner*—N. Le
*Assistant Examiner*—Michael Nghiem
(74) *Attorney, Agent, or Firm*—Fitzpatrick, Cella, Harper & Scinto

(57) ABSTRACT

A liquid ejecting apparatus, such as an ink-jet printing apparatus includes a blade for wiping a surface of a liquid ejecting head for ejecting a liquid and a device for cleaning the blade with achieving expansion of life and permitting efficient process. The apparatus achieves reduction of frequency of scrubbing contact between the blade and the liquid ejecting surface and high efficiency in recovery process associated with wiping operation and so forth. Also, by providing a washing liquid for the blade upon termination of printing, the blade may be maintained in sufficiently wetted condition.

35 Claims, 18 Drawing Sheets

U.S. PATENT DOCUMENTS

| | | | | |
|---|---|---|---|---|
| 4,608,577 | | 8/1986 | Hori | 347/66 |
| 4,723,129 | | 2/1988 | Endo et al. | 347/56 |
| 4,740,796 | | 4/1988 | Endo et al. | 347/56 |
| 5,068,674 | | 11/1991 | Sato et al. | 347/62 |
| 5,103,244 | * | 4/1992 | Gast et al. | 347/33 |
| 5,126,765 | | 6/1992 | Nakamura | 347/33 |
| 5,132,710 | | 7/1992 | Ejiri et al. | 347/35 |
| 5,138,343 | | 8/1992 | Aichi et al. | 347/30 |
| 5,170,186 | | 12/1992 | Shimamura et al. | 347/33 |
| 5,182,582 | | 1/1993 | Okamura | 347/33 |
| 5,245,362 | | 9/1993 | Iwata et al. | 347/23 |
| 5,289,213 | | 2/1994 | Murai et al. | 347/28 |
| 5,552,811 | * | 9/1996 | Kurata et al. | 347/28 |

* cited by examiner

LIQUID EJECTING APPARATUS WITH VARIABLE WIPING OF A LIQUID EJECTION HEAD

This application is a continuation of application Ser. No. 08/301,419 filed Sep. 9, 1994.

BACKGROUND OF THE INVENTION

1. Field of the Invention

The present invention relates to a liquid ejection device employing a liquid ejection head for ejecting a liquid, such as an ink or so forth. More specifically, the invention relates to a printing apparatus for performing printing on a printing medium, such as paper, cloth, non-woven fabric, an OHP sheet and so on. The present invention is particularly effective for a printing apparatus which performs printing for a long period or performs continuous printing on a cloth having printing width of 1 m or more. In concrete, the invention is applicable for office use devices, such as a printer, a copy machine, a facsimile and so forth, a mass-production apparatus, such as a textile printing apparatus, a device for driving an article by an ejected liquid, and so forth.

It should be noted that throughout this specification and drawings, the wordings "print" or "record" means not only the operation for adhering ink on a recording medium, such as paper or the like, but also the operation applying an appropriate liquid for a medium in a broader sense, and includes textile printing for applying dye or the like on cloth, and so forth, for example.

2. Description of Related Art

As conventional liquid ejecting devices, there are devices for performing recording by ejecting a liquid or for ejecting a special liquid and utilizing the ejected liquid. In general, since an ejecting portion for ejecting the liquid is quite small, it tends to cause failure of ejection by causing solidification of dye or pigment contained in the liquid or by adhering of foreign matters to make it difficult to effectively use the ejected liquid. For example, in a recording apparatus, failure of ejection of the liquid results in failure of recording. Normally, in order to avoid such problems, forced ejection of the liquid by suction, pressurization or so forth, cleaning of an ejecting region including an ejecting portion, or ejecting gas or liquid to the ejecting portion in the ejecting region is performed at an appropriate intervals as recovery process.

While ejecting liquid to the ejecting portion by a recovering means to solve ink of increased viscosity or solidified ink and so forth, and washing out the adhering matter with the liquid is effective for avoiding failure of ejection, such method may cause sucking of a washing liquid into an ejection nozzle in the vacuum condition to lower ink concentration and thus causes lowering of printing density.

On the other hand, with a recovering means not employing the washing liquid, the ink of increased viscosity may adhere in the vicinity of the nozzle of the ejection head to cause plugging or ink ejection failure.

Moreover, in the case where the liquid is forcedly discharged from the ejecting portion by sucking, if the ejection head having a plurality of ejection nozzles is employed, an internal volume of a cap to be tightly fitted to the ejection head upon suction becomes large to make vacuum control difficult.

Also, in the method simply contacting a sponge onto the ejection head, if the ejection nozzle with a fine nozzle, such as for 400 dpi, it possibly causes foreign matters to be pushed into the nozzle resulting in causing failure.

Furthermore, in order to avoid accumulation of a mist splashing upon ejection of the ink on the surface of the head to block the ejecting orifice to cause ejection failure or to make ejection impossible (referred to as wet non-ejection), it may be considered to wipe off the surface of the head by a blade. However, when industrial operation is continued for a long period, the wiped ink may have no way to be discharged and thus accumulated and increase viscosity. Therefore, the ejection head may be wiped with the blade on which the high viscous ink is adhering to increase possibility of causing ejection failure. Particularly, in the case of a color recording apparatus, mists from four heads can be collected to make this problem, significant.

In addition, since the head and the wiping means are repeatedly worn, it is desired to take a measure for avoiding shortening of the life. Also, it is desired to perform wiping process efficiently to improve throughput in printing operation.

Furthermore, in the construction where a blade formed of an absorbing body is employed, if ejecting operation or wiping operation is not performed for a long period, or the apparatus body is rested for a long period, the blade may be dried completely so that desired wiping effect cannot be achieved and may affect to the ejecting surface of the head by the wiping operation.

SUMMARY OF THE INVENTION

According to a first aspect of the present invention, there is provided a liquid ejecting apparatus for ejecting a predetermined liquid enjoying a liquid ejection head, comprises:

wiping means for wiping a surface of the liquid ejection head through which the liquid is ejected; and means for varying a wiping condition of the surface of the liquid ejection head by the wiping means.

The liquid ejecting apparatus may further comprise means for varying the wiping condition during operation of the liquid ejecting apparatus.

The wiping means may include porous material blade.

The liquid ejecting apparatus may further comprise cleaning means for cleaning the wiping means, the cleaning means including liquid ejecting means for ejecting a washing liquid to the wiping means.

The cleaning means may include liquid sucking means for sucking liquid from the wiping means.

The liquid ejection heads may be reciprocated, and the means for varying the wiping condition may vary wiping direction relative to the liquid ejection head.

The liquid ejection heads may be reciprocated, and the means for varying the wiping condition may vary wiping direction relative to the liquid ejection head.

Before recording operation of the liquid ejecting apparatus, the wiping direction may be reciprocating traveling directions of the liquid ejection head, and during recording, the wiping direction may be a reversed traveling direction of the liquid ejection head.

The wiping condition to be varied may be a rotative wiping speed between the wiping means and the liquid ejection head.

The liquid ejection head may be reciprocated and the means for varying the wiping condition may vary a relative wiping speed between the wiping means and the liquid ejection head.

The wiping speed before recording operation of the liquid ejecting apparatus may be lower than that in the wiping speed during recording.

The wiping condition to be varied may be a penetration amount of the wiping means into the liquid ejection head.

The liquid ejection head may be reciprocated, and the wiping condition to be varied may be a penetration amount of the wiping means into the liquid ejection head.

The relative penetration amount before the recording operation of the liquid ejecting apparatus may be greater than that upon recording.

The wiping condition to be varied may be a content of a washing liquid of the wiping means.

The liquid ejection head may be reciprocated, and the wiping condition to be varied may be a content of a washing liquid of the wiping means.

The washing liquid content before recording operation of the liquid ejecting apparatus may be greater than that upon recording.

The wiping condition to be varied may be frequency of contact of the wiping means and the liquid ejecting surface.

The liquid ejection head may be reciprocated, and the wiping condition to be varied may be frequency of contact of the wiping means and the liquid ejecting surface.

The contacting frequency before recording operation of the liquid ejecting apparatus may be higher than that upon recording.

The liquid ejecting apparatus may comprise, as recovery means for maintaining good ejecting condition of the liquid ejection head, means for performing a process employing the wiping means, means for performing a process employing the wiping means and pressurizing an ink supply system, and means for performing ejection of ink through the liquid ejection head for other than printing, and means for varying processing conditions of these means for performing processes depending upon an image data.

According to a second aspect of the present invention, there is provided a liquid ejection printing apparatus for performing printing with employing a plurality of liquid ejection heads, comprising:

means for performing substantial recovery process including ink pressurizing recirculating process and wiping process for the heads;

means for performing preparatory ejection;

means for performing wiping process for the heads; and means for deriving a maximum printing duty in the plurality of liquid ejection heads on the basis of an image data before initiation of printing, and for setting frequency of insertion of the substantial recovery process, the preparatory ejection process and the wiping process in predetermined printing operation depending upon the maximum printing duty.

The liquid ejection head may have an element for generating thermal energy as energy to be used for ejecting the liquid.

According to a third aspect of the present invention, there is provided a liquid ejecting apparatus for ejecting a predetermined liquid employing a liquid ejection head comprising:

wiping means for wiping a surface of the liquid ejection head through which the liquid is ejected;

cleaning means for cleaning the wiping means by providing washing liquid for the wiping means; and drying preventing means for preventing the wiping means from drying.

The drying preventing means may make the cleaning means to provide a washing liquid to the wiping means after termination of ejection by the liquid ejection head.

The drying preventing means may make the cleaning means to provide a washing liquid to the wiping means at a predetermined timing after termination of ejection by the liquid ejection head.

The drying preventing means may have means for enclosing the wiping means.

The wiping means may include a sponge-like porous material.

The liquid ejecting apparatus may further comprise means for adjusting a water content in the sponge-like porous material before initiation of recording.

The water content to be adjusted before initiation of recording may be smaller than the water content of the sponge-line porous material after termination of recording.

The water content adjusting means may comprise means for providing washing liquid to the sponge-like porous material and means for sucking a predetermined amount of the washing liquid from the sponge-line porous material.

The liquid ejecting apparatus may further comprise means for detecting presence and absence of the enclosing means for the wiping means in advance of liquid ejecting operation.

The liquid ejection head may have an element for generating thermal energy as energy to be used for ejecting the liquid.

The above and other objects, effects features and advantages of the present invention will become more apparent from the following description of embodiments thereof taken conjunction with the accompanying drawings.

BRIEF DESCRIPTION OF THE DRAWING

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
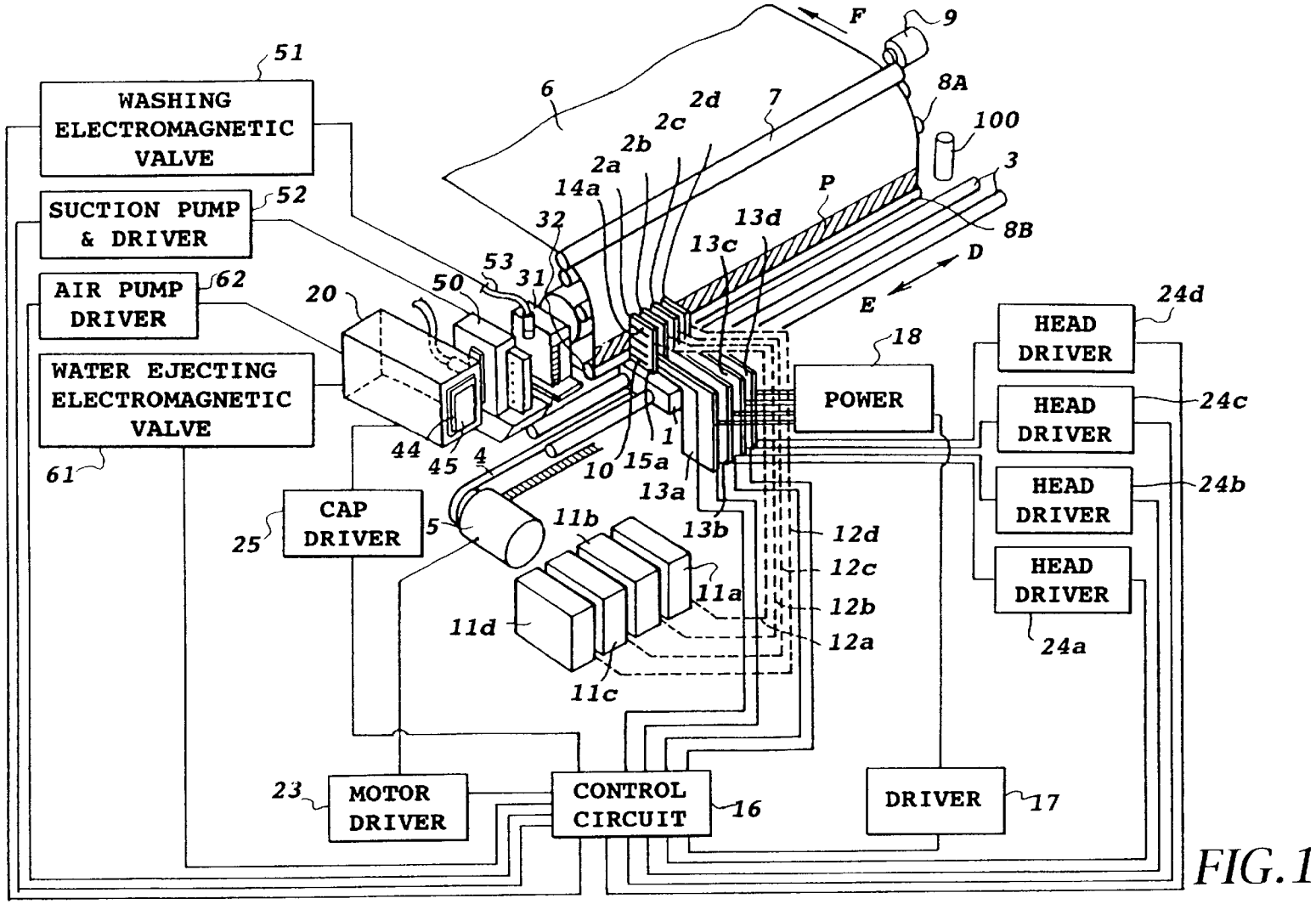
FIG. 1 is a perspective view showing an construction of an ink-jet printing apparatus as one embodiment of an apparatus, to which the present invention is applied.

FIG. 1 shows one example of a construction of an ink-jet printing apparatus as a liquid ejecting apparatus, for which the present invention is applied.

In the drawings, a carriage 1 mounts printing heads 2*a*, 2*b*, 2*c* and 2*d* corresponding to four colors, i.e. cyan, magenta, yellow and black, for color printing. A guide shaft 3 supports the carriage 1 for guiding movement of the latter. Reference numerals 22*a*, 22*b*, 22*c* and 22*d* denote ejecting surfaces of respective printing heads (see FIG. 5).

A belt 4 as an endless belt is connected to the carriage 1 at a part. The carriage 1 is driven to move along a printing surface of a printing medium 6, such as paper, OHP film, cloth and so forth (which will be hereinafter referred to as "printing paper") on the guide shaft 3 by a driving motor 5 comprising a pulse motor which is driven by a motor driver 23, via the belt 4. Also, the printing apparatus includes a feeding roller 7 for feeding the printing paper 6, guide rollers 8A and 8B for guiding the printing paper, and a printing paper transporting motor 9.

For each of the printing heads 2*a*, 2*b*, 2*c* and 2*d*, a liquid passage 10 is provided for ejecting ink droplet toward the printing paper 6. To the liquid passages 10, inks are supplied from ink tanks 11*a*, 11*b*, 11*c* and 11*d* corresponding to the printing heads 2*a*, 2*b*, 2*c* and 2*d* via supply tubes 12*a*, 12*b*, 12*c* and 12*d*, respectively. For means provided in respective liquid passages 10 for generating energy to be utilized for ejecting inks, ink ejection signals are selectively supplied from respective head drivers 24*a*, 24*b*, 24*c* and 24*d* via flexible cables 13*a*, 13*b*, 13*c* and 13*d*.

Furthermore, on respective printing heads 2*a*, 2*b*, 2*c* and 2*d*, head heaters 14*a*, 14*b*, 14*c* and 14*d* (14*b*, 14*c* and 14*d* are not shown in FIG. 1) and temperature detecting means 15*a*, 15*b*, 15*c* and 15*d* (15*b*, 15*c* and 15*d* are not shown in FIG. 1) are provided. Detection signals from the temperature detecting means 15*a*, 15*b*, 15*c* and 15*d* are input to a control circuit 16 including CPU. The control circuit 16 controls heating of the head heaters 14*a*, 14*b*, 14*c* and 14*d* via a driver 17 and a power source 18 on the basis of the detection signals.

A capping means 20 is adapted to be contacted with the ejection orifice surface of respective printing heads 2*a*, 2*b*, 2*c* and 2*d* during non-printing state. In the non-printing state, the printing heads 2*a*, 2*b*, 2*c* and 2*d* are moved to the positions mating with the capping means 20. At this time, the capping means 20 is driven to move forward by a cap driver 25 so as to depress an elastic member 44 onto the ejection orifice surface for establishing capping.

When the printing heads are left in the resting state with exposing to the atmosphere for a long period, ink in the ejection orifice may be evaporated to increase viscosity to make ejection unstable. In order to avoid this, during non-printing state, the nozzle portions are shielded from the atmosphere and enclosed (capping). In the inside of the cap portion, a liquid absorbing member held in wet state by ink is provided to maintain the interior of the cap portion at high humidity to minimize increasing of viscosity of the ink.

If the printing heads are left in the capping position for a long period, recovery is performed by pressurizing ink. Namely, when the printing heads are left in the capped state for a long period, the ink within the ejection orifice is evaporated to increase viscosity, though evaporation is caused quite moderately. Also, there are a few possibility to cause residual of bubble in the ejection orifice to border stable ejection. Therefore, upon initiation of painting, a pump provided in the ink tank is driven to pressurize the ink to discharge the ink of increased viscosity and bubble in the ejection orifice. This is also effective when feather, dust or so forth is adhering on the ejection surface or dust is penetrating within the ejection orifice, to wash out them to maintain stable ejection.

A blocking preventing means 31 is adapted to receive the ejected ink when the printing heads 2*a*, 2*b*, 2*c* and 2*d* perform preparatory ejection. The blocking preventing means 31 is located in opposition to the printing heads 2*a*, 2*b*, 2*c* and 2*d* and has a liquid receptacle member 32 as a liquid receiving portion for absorbing ink ejected in preparatory ejection. The blocking preventing means 31 is arranged at a position between the capping means 20 and the printing initiating position. It should be noted that as a material for the liquid receptacle member 32 and a liquid holding member 45, sponge-like porous materials or sintered plastics are effective.

It should be noted that preparatory ejection is performed by ejecting ink not for the purpose of printing but for temperature compensation at the regions where the temperature is lowered due to ejection of liquid or discharging of gas and for removing of foreign matters within the ejection orifice. Also, in addition to this, a predetermined driving pulse is provided in advance of initiating printing to eject inks through all ejection orifices toward the cap or so forth (aging operation). Also, when humidity in the circumferential atmosphere of the ejection orifices, ejection may be performed in the capping state.

To a cleaning means 50, an electromagnetic valve 51 for washing and a suction pump driver 52 are connected for ejecting a washing liquid from a wiping washing means 53 and for sucking the washing liquid from the cleaning means 50, respectively, under the control of the control means 16.

Figure 2:
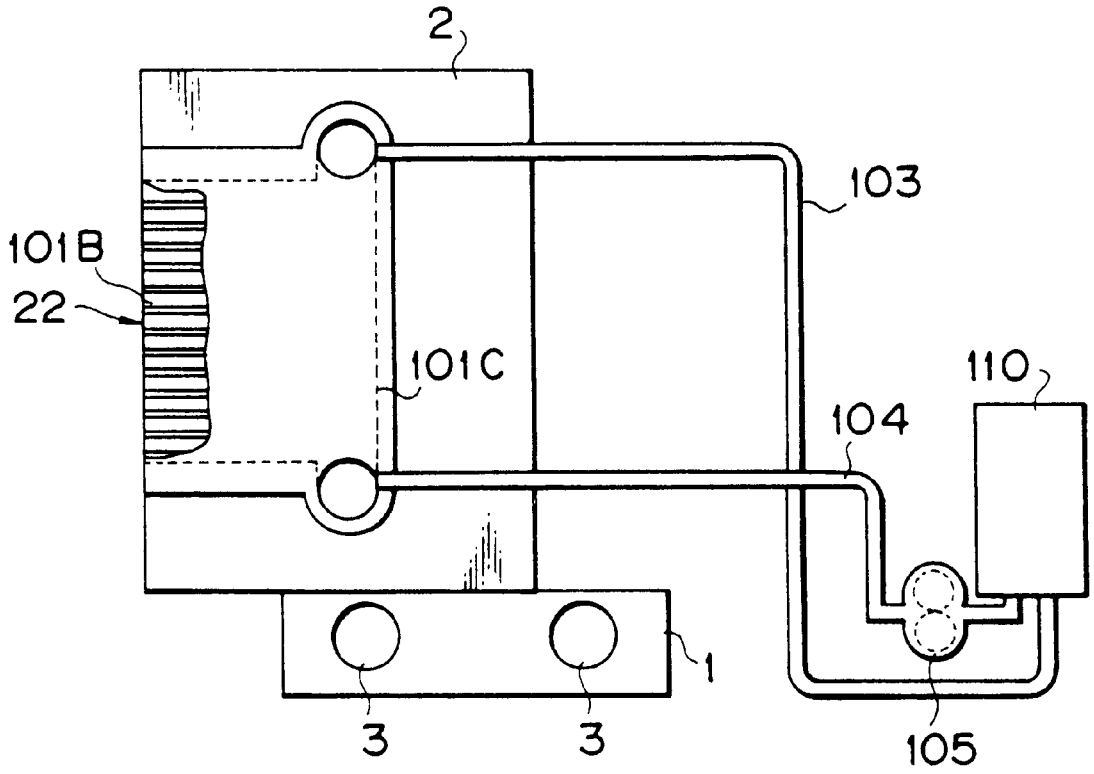
FIG. 2 is a diagrammatic sectional side elevation showing a head and an ink system in the ink-jet printing apparatus of FIG. 1.

FIG. 2 shows an example of a construction of a liquid ejection head. Reference numeral 2 denotes an ejection head, 22 denotes an ejection surface. 101B denotes a nozzle portion, in which a plurality of liquid flow passages are vertically arranged in parallel relationship to each other. In each of the flow passages, an ejection energy generating element, such as electrothermal transducer, is provided. 101C denotes an ink chamber supplying ink in common to respective liquid flow passages, which ink chamber 101C is connected to an ink tank 110 via a supply tubes 103 and 104. A gear pump 105 is provided in one of the supply tubes 104 so that pressurized ink is supplied to an ink supply system of the printing head 2, during the ejecting recovery process including removal of bubble or dust penetrated in the supply passages or the nozzle portion 101B and so forth and removal of the ink of increased viscosity, for forcedly ejecting or discharging ink through the ejection orifices or for refreshing ink by recirculating ink in the ink supply tubes 103 and 104 and the ink chamber 101C (hereinafter referred to as pressurizing recirculating process).

Figure 3:
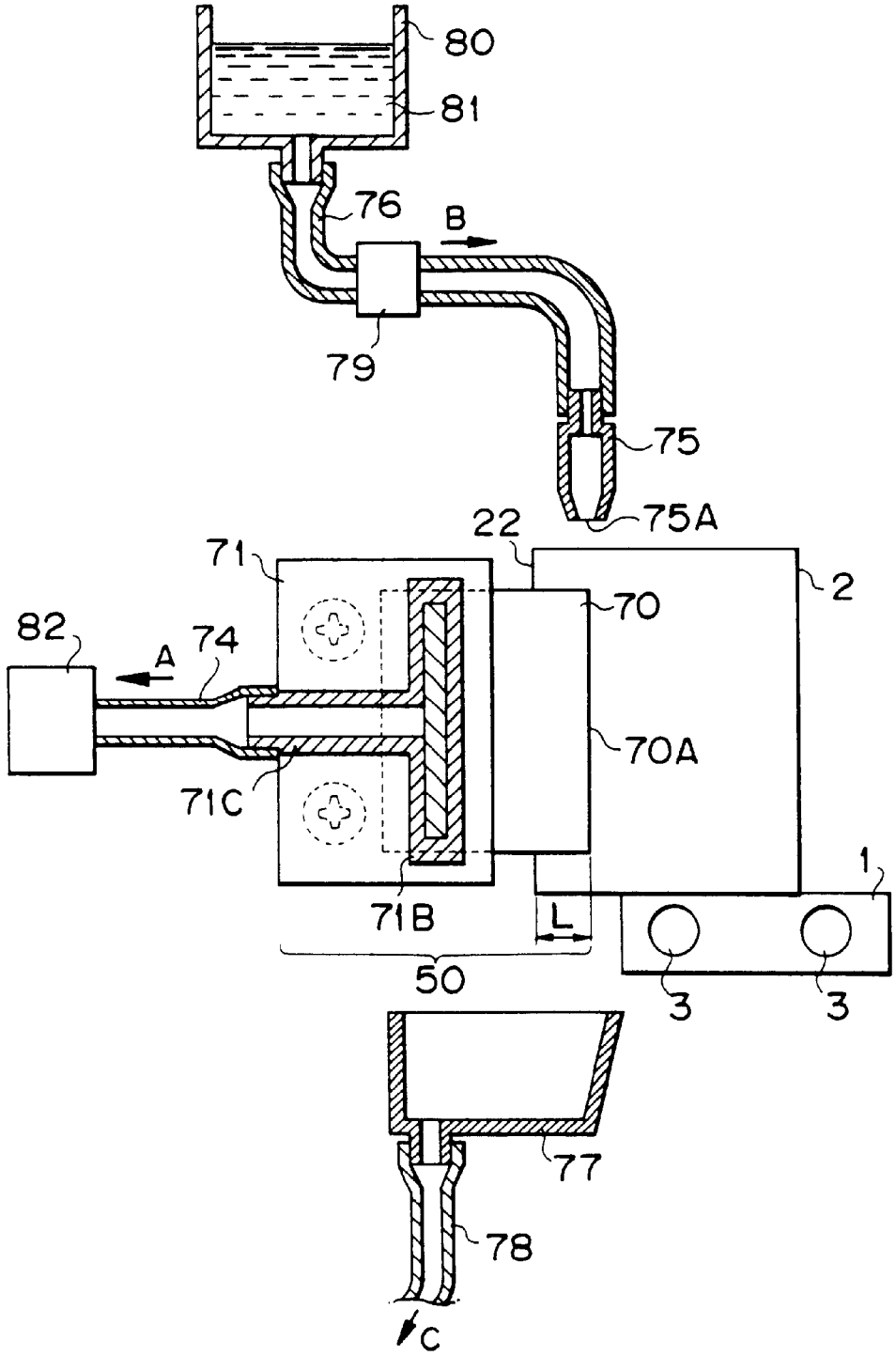
FIG. 3 is a diagrammatic illustration showing an example of construction of a recovery means including a wiping means and a cleaning means.
Figure 4:
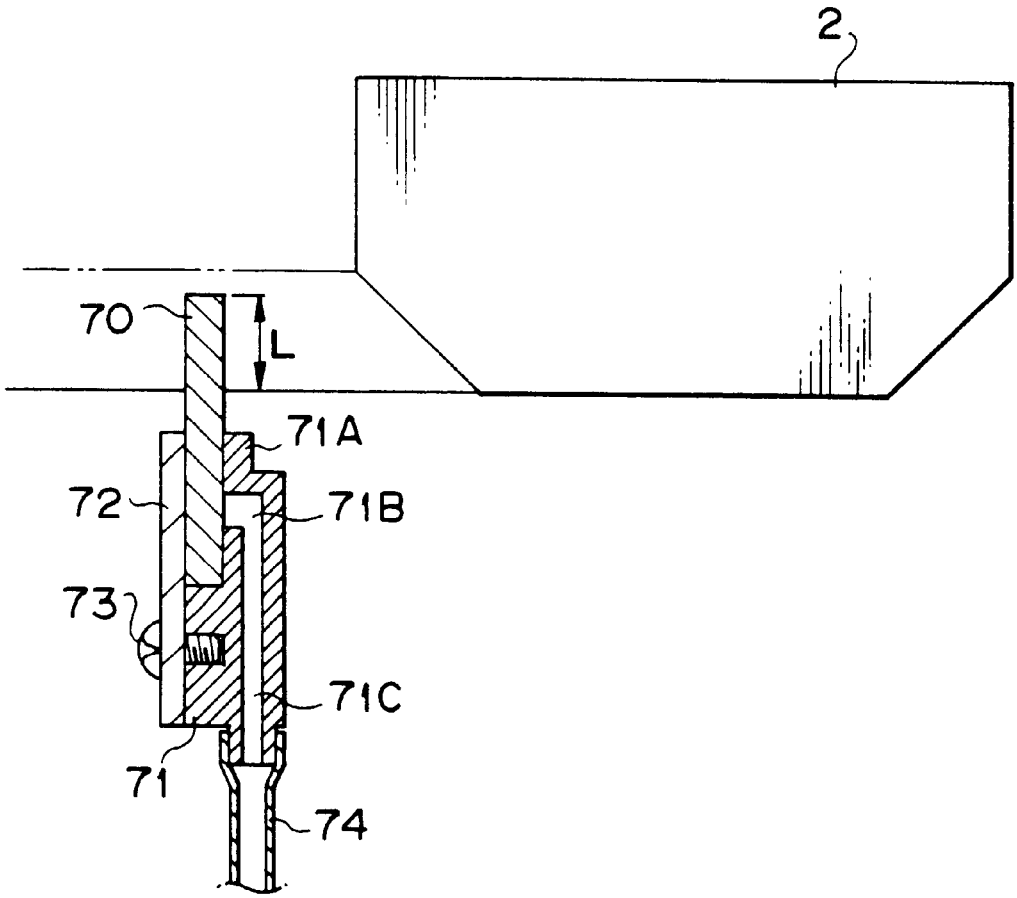
FIG. 4 is a diagrammatic illustration showing an example of construction of the wiping means in the shown embodiment.

FIGS. 3 and 4 show a construction of the cleaning means 50. FIG. 3 is an explanatory illustration of the cleaning means 50 as seen from a primary scanning direction of the head. FIG. 4 is an explanatory illustration of a cleaning member 70 and the head 2 as seen from the above. In the shown embodiment, cleaning member 70 as a wiping means is the form of a wiping blade made of a porous material having flexibility. As the material for the cleaning member, a high polymer porous material may be used. In the case where the high polymer porous material is employed for forming the wiping blade, a preferred material is not to cause significant volume variation by absorption of ink mist and not to cause volume variation even with absorbing the ink. For instance, foamed formal resin type material may be preferred.

Also, as an ink absorbing material to be employed in the shown embodiment, sintered type high polymer porous material can be used. For example, sintered material of low density polyethylene, high density polyethylene, high molecular polyethylene, composite polyethylene, polypropylene, polymethyl methacrylate, polystyrene, acrylonitrile type copolymer, ethylene-vinylacetate copolymer, fluororesin, phenolic resin may be preferred. Amongst, preferably, low density polyethylene, high density polyethylene, high molecular polyethylene and polypropylene are further preferred in view of ink mist absorbing ability and ink corrosion resistance.

Reference numeral 71 denotes a holder which is cooperative with a fixing plate 72 to clamp the cleaning member 70 therebetween. 73 denotes a screw for fixing. For the holder 71, an opening 71B is formed on the surface 71A mating with the cleaning member 70. The opening 71B is connected to a suction tube 74 via a communication passage 71C for discharging the washing liquid and ink absorbed in the cleaning member 70 by a suction means 82 of a pump, in the direction shown by arrow A. The suction means 82 may be a discharge means having a porous member or a fibrous member connected to the cleaning member to form liquid discharge passages for discharging the washing liquid from the cleaning member therethrough.

By sucking of the washing liquid, the residual amount of the washing liquid in the cleaning member 70 is appropriately adjusted to recover the capability of absorption of ink or foreign matter of the cleaning member. This improves cleaning efficiency of the ejection surface 22 of the head 2. Also, the cleaning member 70 is reciprocally movable between a retracted position and an extracted position, at which a tip end 70A thereof overlaps with the ejection surface 22 of the ejection head by overlapping length L. During travel of the head 2, the ejecting surface 22 of the head 2 can be wiped with the overlapping portion.

Reference numeral 75 denotes a washing liquid supply nozzle, to which a washing liquid 81 is supplied from a tank 80 as a washing liquid supply means via a washing liquid supply tube 76 in the direction shown by arrow B by opening of an electromagnetic valve 79. The washing liquid is then downwardly supplied to the cleaning meter 70 from a discharge portion 75A of the nozzle to wash the cleaning member 70.

Reference numeral 77 denotes a receiving tray arranged beneath the cleaning member 70. When the washing liquid is supplied from the supply nozzle 75, the receiving tray 77 receives the washing liquid dropping without being absorbed in the cleaning member 70 or ink or foreign matters washed by the washing liquid and dropping therewith. 78 denotes a drain tube for draining the washing liquid received in the receiving tray to a drain portion (not shown) in the direction shown by arrow C.

Figure 5:
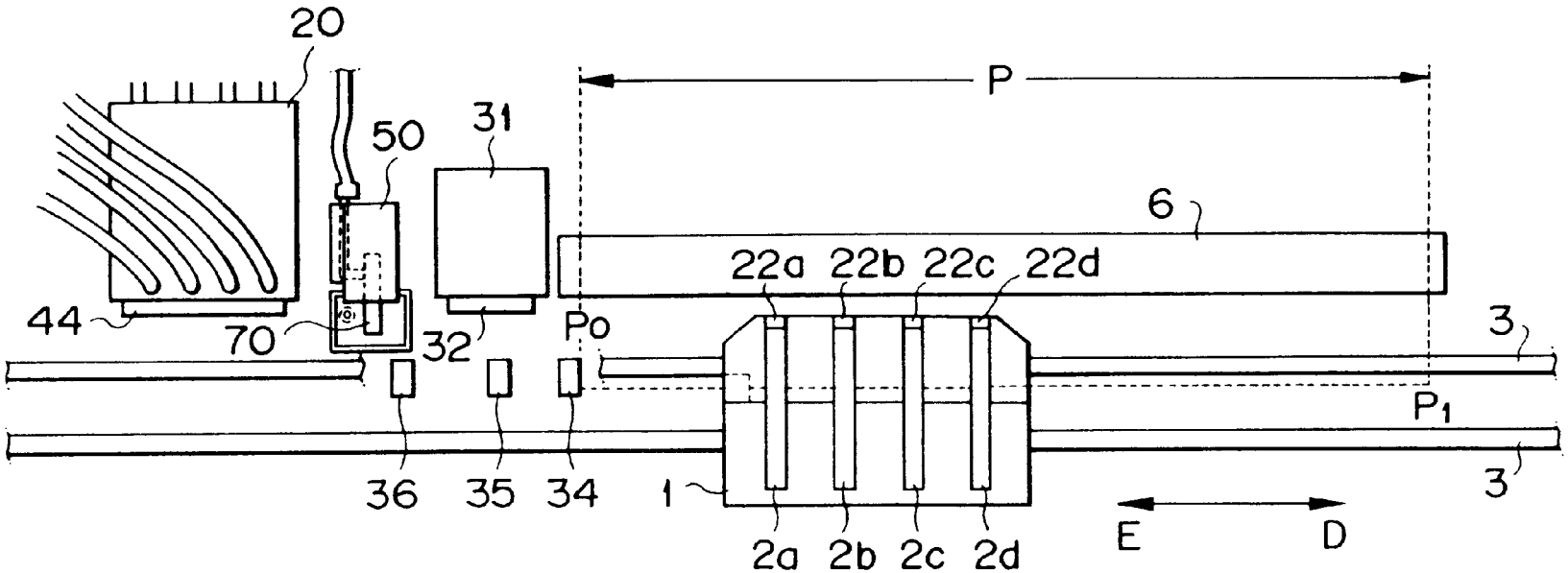
FIG. 5 is a diagrammatic plan view showing an example of construction around a home position in FIG. 1.

Next, the operation of the ink-jet printing apparatus will be discussed. In FIG. 5, a printing initiation detecting sensor 34 and a capping means detecting sensor 36 respectively detect respective printing heads 2*a*, 2*b*, 2*c* and 2*d* being at the predetermined capping position. A preparatory ejection detecting sensor 35 detects a reference position for the preparatory ejecting operation to be performed while the printing heads 2*a*, 2*b*, 2*c* and 2*d* are moving in the scanning direction.

Figure 6:
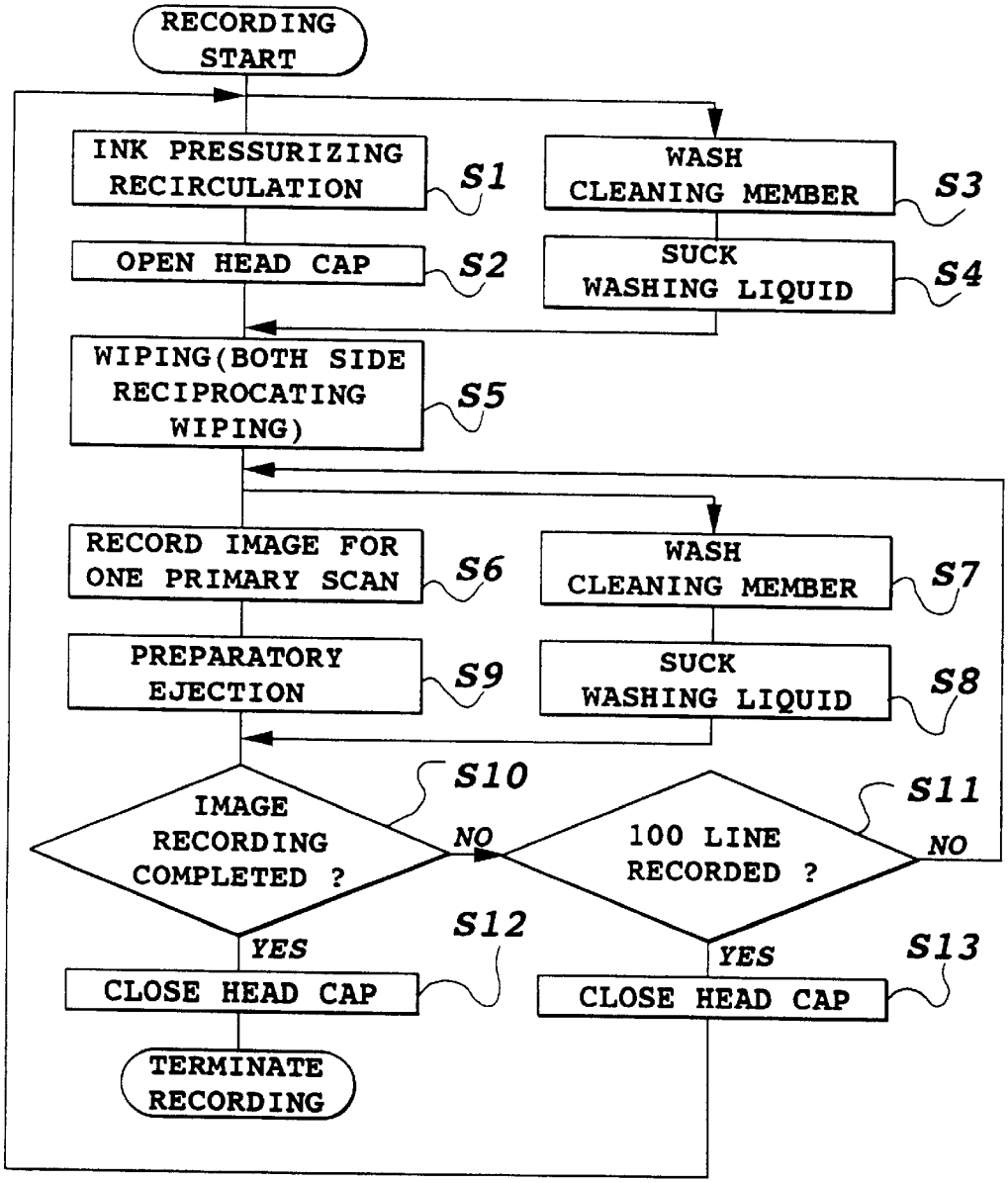
FIG. 6 is a flowchart showing one example of a printing sequence as a base of the present invention.

FIG. 6 shows a flowchart showing one example of an operation sequence of the shown embodiment of the printing apparatus. Initially, at the stand-by state, the ejecting surfaces 22*a*, 22*b*, 22*c* and 22*d* of the printing heads 2*a*, 2*b*, 2*c* and 2*d* are capped by the capping means 20. When a printing signal is input by the control circuit 16, the gear pump 105 is driven to initiate pressurized recirculation of the ink (step S1) . Then, the head cap is opened (step S2).

In conjunction with the ink pressurized recirculation for recovery, washing of the cleaning member 70 is performed (step S3). By this washing, ink of the increased viscosity and foreign matter adhering on the cleaning member 70 are washed off with the washing liquid.

Next, at step S4, the suction pump 82 is driven to suck the washing liquid to appropriately reduce the amount of the washing liquid maintained in the cleaning member 70. By this, ink and foreign matter collection performance of the cleaning member 70 is improved for enhancing the cleaning efficiency by the cleaning member 70. Also, by sucking the washing liquid, a vacuum is generated within the porous material as the cleaning member 70 by capillarity. By making this vacuum to be greater than the vacuum (meniscus forming force) exerted to the nozzle of the liquid ejection head, the ink is drawn from the nozzle during cleaning so as to successfully prevent the washing liquid from penetrating into the liquid chamber. Furthermore, since a force for sucking ink within the nozzle, the vacuum generated in the porous material is effective for removing the ink of the increased viscosity from the nozzle.

Figure 7:
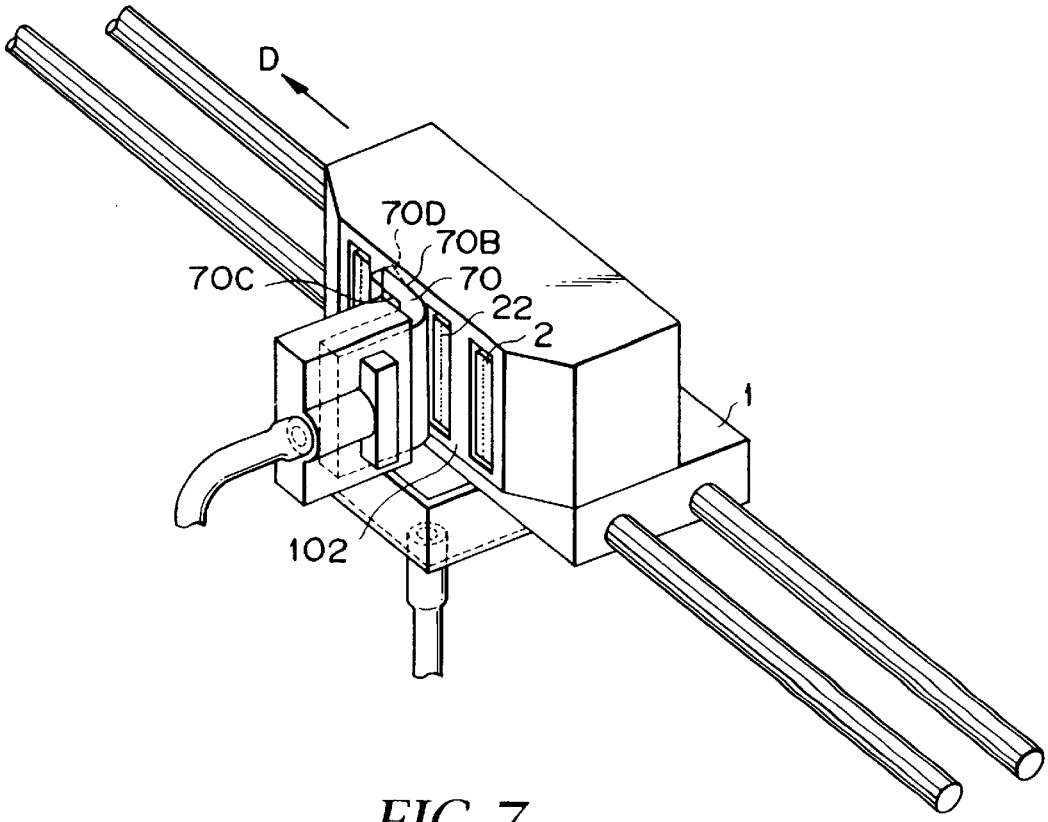
FIG. 7 is an explanatory illustration of the wiping operation.

Next, when a drive signal is generated from the motor driver 23 and thus a driving torque of the drive motor 5 is transmitted to the carriage 1 via the belt 4, the carriage 1 is driven to move for reciprocating the head. Then, as shown in FIG. 7, the cleaning member 70 wipes the ejecting surface 22 when the carriage passes across the position of the cleaning member 70 for cleaning the head (step S5). Here, in the shown embodiment, the term "wipe" means wiping and cleaning the washing liquid, ink, foreign matter and so forth on the ejecting surface.

As shown in FIG. 7, when the ejecting surface is wiped by means of the cleaning member 70, since the cleaning member 70 is flexible, it may fallen in the direction same as the moving direction D of the carriage 1 to wipe the ejecting surface with a small elastic restoration force. In the forward travel of the carriage 1, a wiping surface 70B of the cleaning member 70 wipes the ejecting surface 22, and in the reverse travel of the carriage 1, a wiping surface 70C wipes the ejecting surface, for performing cleaning. Therefore, even when there is a step between a holder surface 102 and the ejecting surface, such step may not affect for effect of cleaning.

Particularly, since an edge portion 70D of the cleaning member 70 may penetrate into a recess of the holder, the stepped portion between the holder surface 102 and the ejecting surface 22 can also be cleaned.

As the carriage 1 travels in the direction shown by arrow D from the printing initiation detecting position $P_0$ detected by the printing initiation detecting sensor 34, ink droplets are ejected to perform printing of an image at printing width portion P on the printing paper 6 (step 6).

In conjunction therewith, washing of the cleaning member is performed (step S7). Then, suction of the washing liquid is performed for recovery of the cleaning performance of the cleaning member (step S8). Subsequently, the traveling direction of the carriage 1 is reversed to be driven in the direction shown by arrow E in FIG. 1 to perform preparatory ejection while the carriage 1 passes the preparatory ejection position (step S9). Here, the preparatory ejection is performed toward the liquid receptacle member 32. Then, the printing paper 6 is fed for a printing amount in the direction shown by arrow F in FIG. 1.

Next, when image printing is continued (when an answer at step S10 is negative) and when printing for 100 lines is not yet completed (when an answer at step S11 is negative), the process is returned to step 5. As set forth, during the travel of the carriage 1 in the reverse direction, the ejection surface 22 is wiped by the wiping surface 70C of the cleaning member 70, and subsequently, as shown in FIG. 7, wiping with the wiping surface 70B of the cleaning member 70 is performed during the forward traveling of the carriage 1 (step 5). In short, wiping of the ejection surface is performed by both surfaces 70B and 70C of the cleaning member 70. At this time, in the forward travel, wiping is performed by the wiping surface 70B without using the wiping surface 70C stained by cleaning in the reverse traveling of carriage, it may not affect for cleaning effect and makes the effect of cleaning twice higher.

On the other hand, when printing of the image is completed (when the answer at step S10 becomes positive, or printing for 100 lines is completed (the answer at step S11 becomes positive), the ejecting surface 22 of the head 2 is capped and enclosed by the capping means 20 (steps S12 and S13).

First Embodiment

Figure 8:
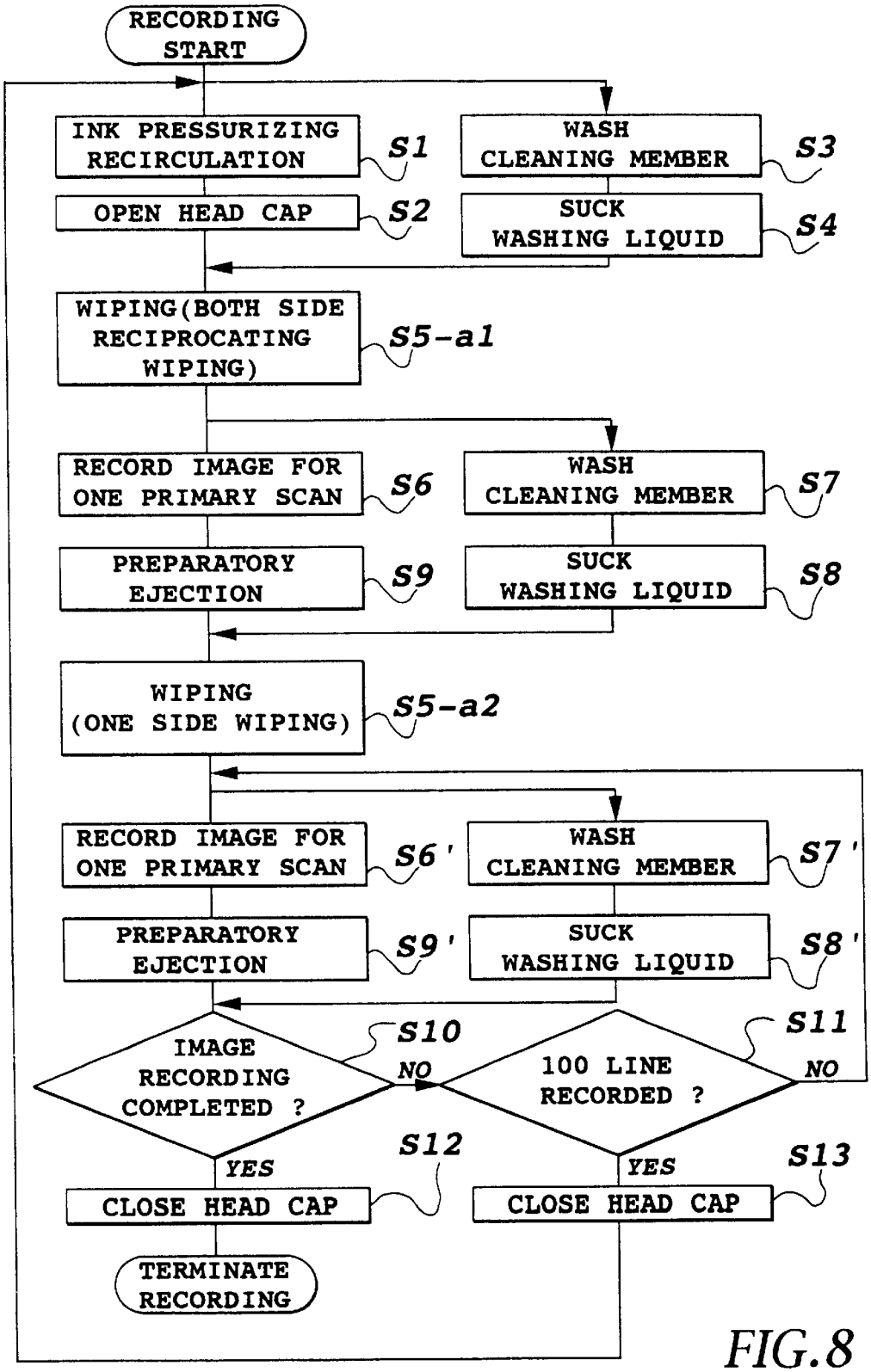
FIG. 8 is a flowchart showing the first embodiment of a printing sequence of the present invention.

With respect to the basic technology set forth above, in order to avoid shortening of life of the cleaning member 70 and the ejecting surface 22 or the head 2, to improve efficiency of recovery process and to lower a running cost by reducing amount of the washing liquid and disposing liquid, this embodiment employs a procedure shown in FIG. 8, in which an appropriate process is added for the procedure illustrated in FIG. 6.

In the procedure of FIG. 8, immediately after the ink pressurizing recirculating operation and so on (steps S1 and S2), the ejecting surface is reciprocally moved across the wiping blade (cleaning member) 70 so as to wipe off a large amount of ink residing on the ejecting surface after ink pressurization (step S5-a1). Then, in the normal printing operation, when the printing head is returned to the home position (travel in the reverse direction), a little amount of ink droplet, such as mist adhering on the head surface is wiped off by one side of the wiping blade 70 (step S5-a2). In the travel of the printing head in the forward direction, the wiping blade 70 is placed at a retracted position so that the wiping blade 70 may not contact with the printing head. Associating therewith, steps S6' to S9' similar to steps S6 to S9 are added.

As set forth, by varying the wiping direction of the wiping blade during printing, frequency of contacting the head 2 and the wiping blade 70 can be reduced with maintaining equivalent wiping performance in comparison with the basic technology set forth above. Therefore, life of the head and the wiping blade can be expanded. Also, since the wiping operation in the forward traveling of the head is neglected and thus the accelerating range of the head (carriage) can be expanded to increase production (printing) speed.

Furthermore, since the washing water of the wiping blade 70 is sufficient to be supplied on one side of the blade 70, smaller amount of washing water is required in comparison with the basic technology with maintaining satisfactory cleaning effect.

Second Embodiment

Figure 9:
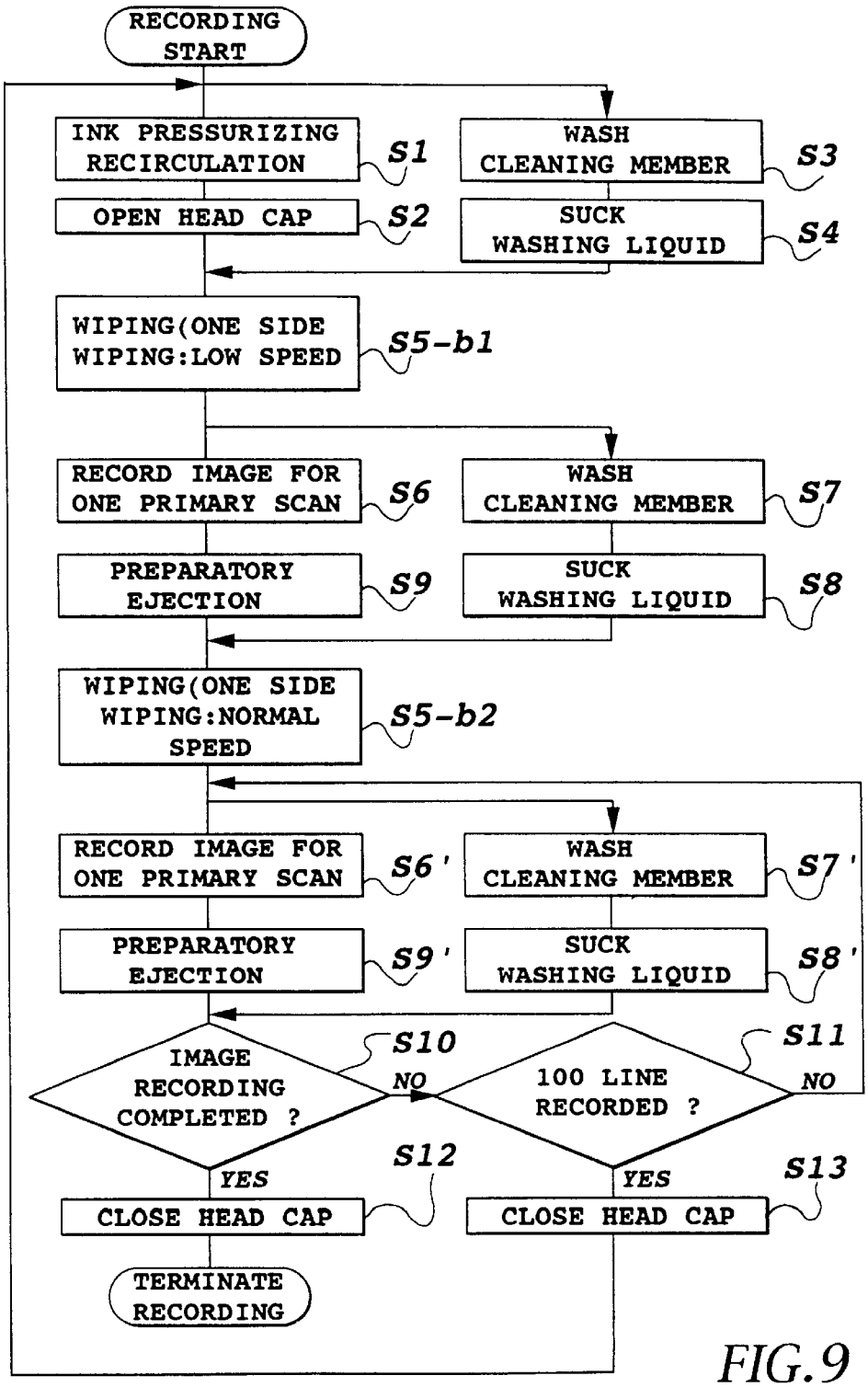
FIG. 9 is a flowchart showing the second embodiment of a printing sequence of the present invention.

FIG. 9 shows a sequence in the second embodiment of the present invention.

In the shown sequence, immediately after ink pressurizing recirculating operation and so on (steps S1 and S2), the ejecting surface is driven to travel at low speed (e.g. 43.3 mm/sec) with respect to the wiping blade 70 to perform wiping (one side wiping, in forward traveling) to sufficiently wipe off a large amount of ink droplet residing on the ejecting surface after ink pressurization (step S5-b1) Then, in the normal printing operation, the ejecting surface is wiped (one side wiping, in reverse traveling at a speed of 86.5 mm/sec, for example) by the wiping blade at a normal speed for wiping off a little amount of ink droplet, such as mist adhering on a projecting surface (step S5-b2). Therefore, throughput in printing may not be lowered.

Thus, during printing, by varying the wiping speed of the wiping blade, the wiping performance equivalent to the first embodiment can be achieved.

Third Embodiment

Figure 10:
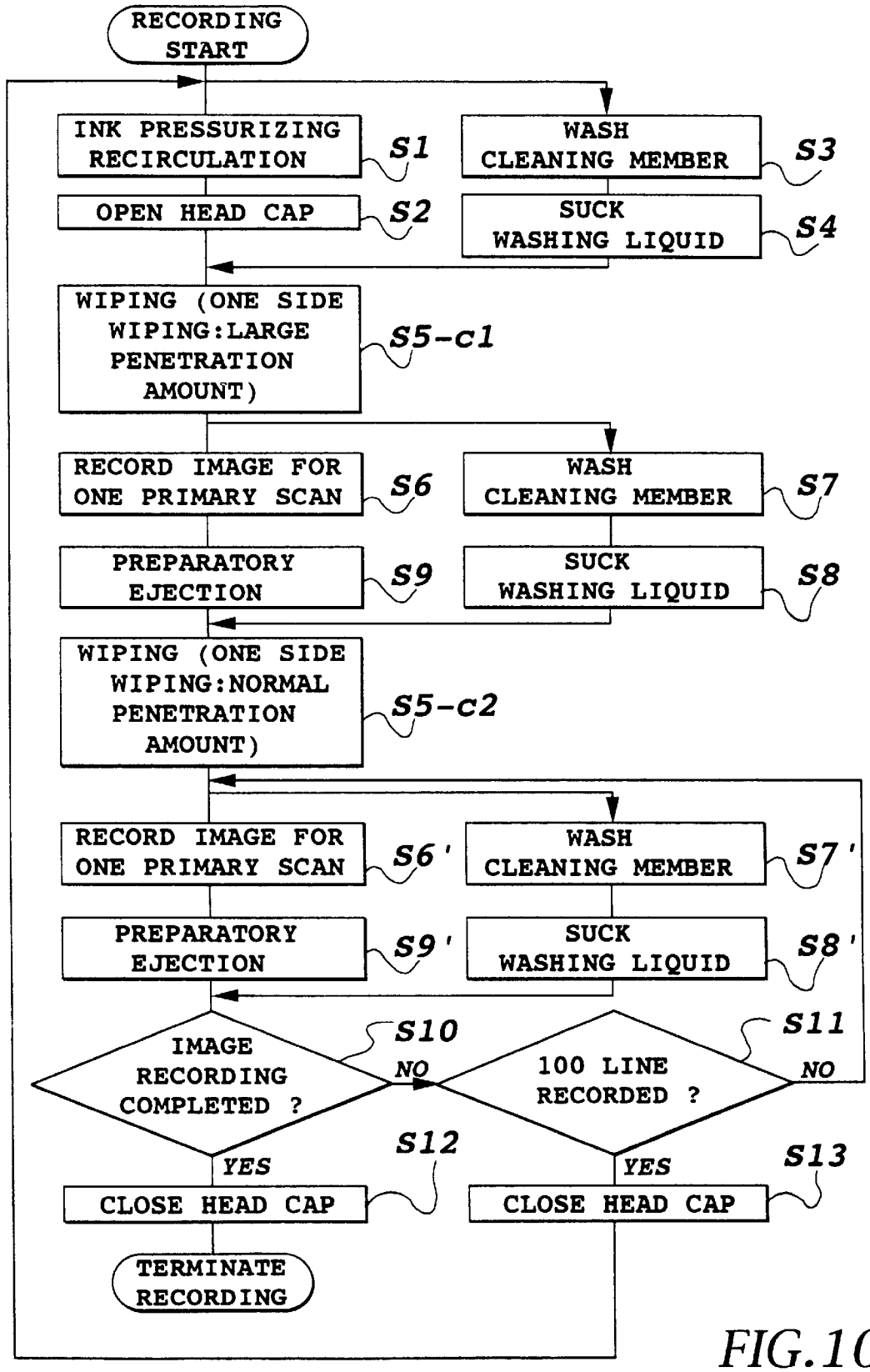
FIG. 10 is a flowchart showing the third embodiment of a printing sequence of the present invention.

FIG. 10 shows a sequence in the third embodiment of the present invention.

In this sequence, immediately after operation of ink pressurizing circulating and so forth (steps S1 and S2), wiping is performed with penetrating the wiping blade 70 into the head holder surface in a penetration amount L=5 mm (FIG. 4) to wipe off a large amount of ink residing on the ejecting surface after ink pressurization. Simultaneously, the ink sticking around the liquid passage and the ejection orifices is certainly removed (Step S5-c1).

Then, during normal printing operation, wiping is performed with penetrating the wiping blade into the head holder surface in a penetrating amount L=3 mm (normal condition) to wipe off a little amount of ink droplet, such as mist adhering on the projecting surface (step S5-c2).

By varying penetrating amount of the wiping blade, contact pressure and wiping width of the wiping blade can be varied. Thus, wiping performance equivalent to the first embodiment can be achieved.

Fourth Embodiment

Figure 11:
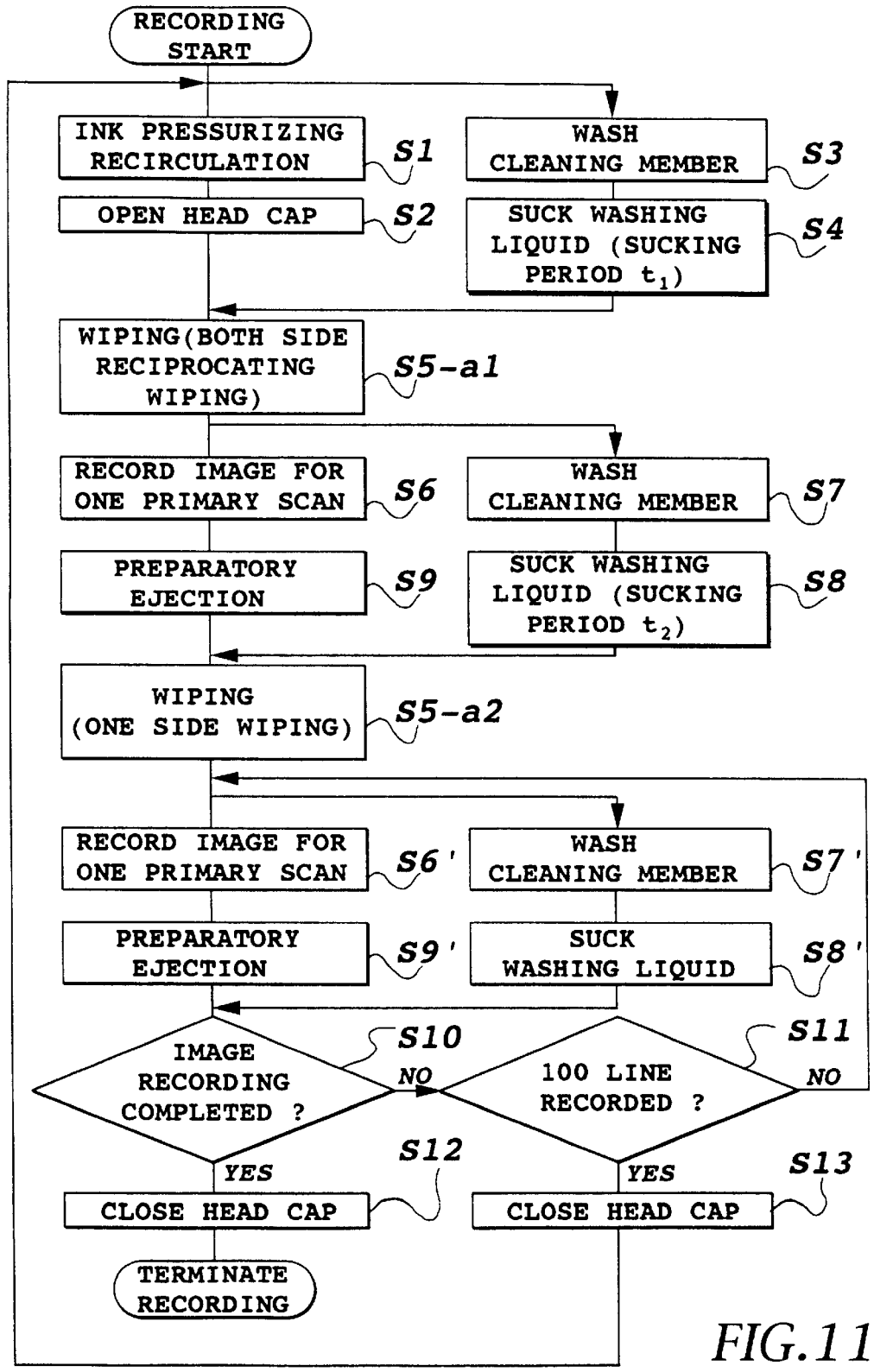
FIG. 11 is a flowchart showing the fourth embodiment of a printing sequence of the present invention.

FIG. 11 shows a sequence in the fourth embodiment of the invention.

In the shown sequence, immediately after ink pressurizing recirculating operation and so forth (steps S1 and S2), wiping operation is performed with setting a pump suction period at $t_1$, e.g. 2 seconds (washing period is 2 seconds) of the wiping blade and with maintaining the wiping blade in wet condition with containing a large amount of water (step S4-2) to sufficiently wipe off a large amount of ink droplet residing on the ejecting surface after ink pressurization, and at the same time, to remove ink sticking in the vicinity of the ejection orifice (steps S5-a1).

Then, during normal printing operation, wiping is performed with setting the pump sucking period at $t_2$ ($>t_1$), e.g. 4 seconds of the wiping blade 70 with slightly wetted condition of the wiping blade 70 (step S8-2) for removing a little amount of ink droplet, such as mist and so forth, adhering on the ejection surface (Step S5-a2).

Thus, the wiping performance equivalent to the first embodiment, namely, capability of removal of sticking of ink after leaving resting condition for a long period, can be achieved.

Fifth Embodiment

Figure 12:
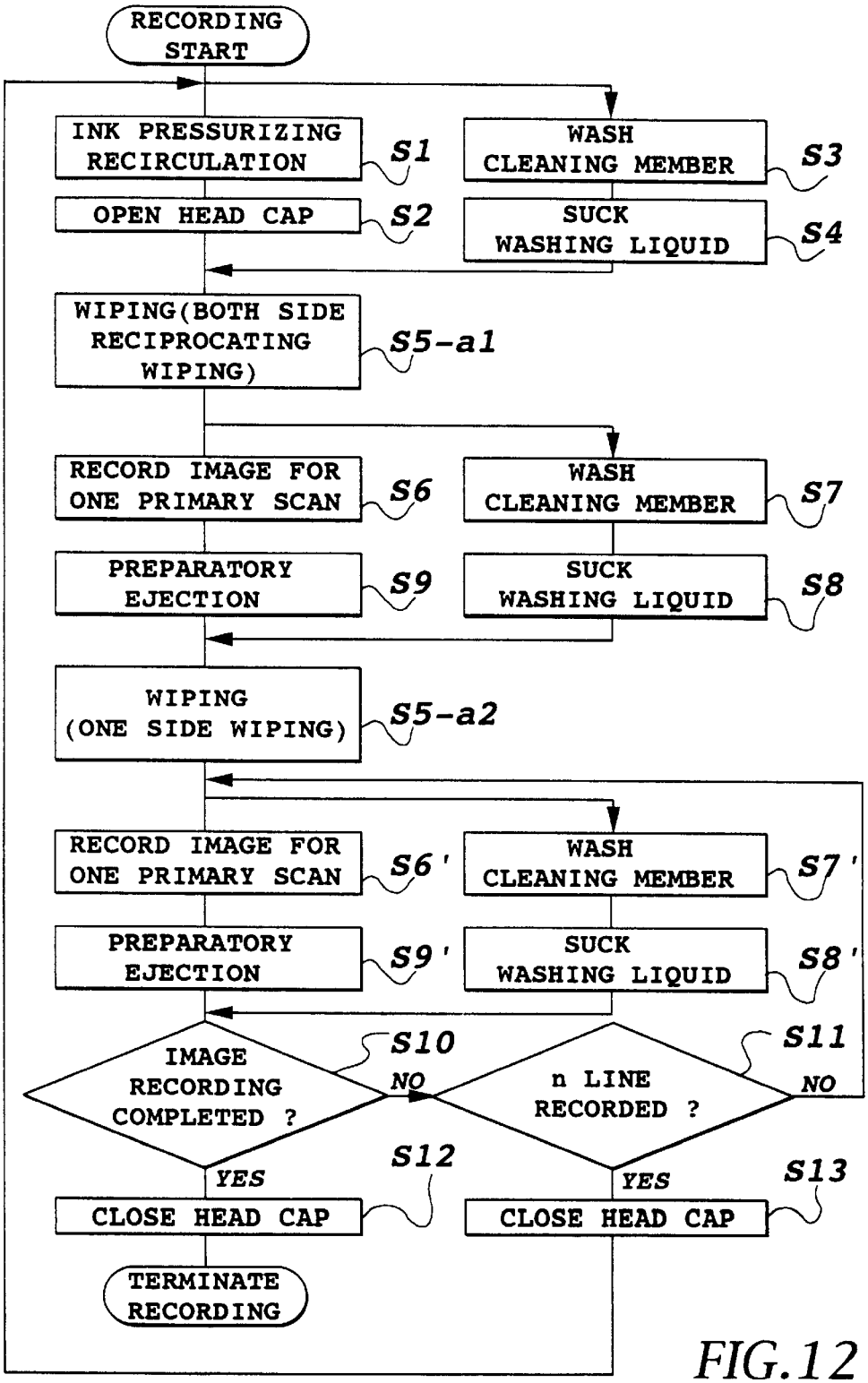
FIG. 12 is a flowchart showing the fifth embodiment of a printing sequence of the present invention.

FIG. 12 shows a sequence in the fifth embodiment of the present invention.

In the shown embodiment, the procedure substantially similar to the fist embodiment illustrated in FIG. 8 is employed. However, the process at step S13 is neglected and during normal printing, a step of performing wiping operation for the ejecting surface one per every n lines (e.g. n=2), is performed in place of the process at step S11 (step S11-2). It should be appreciated that the value n may be set depending upon the image to be printed. Namely, for the image having high image printing duty, the value of n is set at small value, and for the image having low image printing duty, the value of n is set at large value. The setting may be performed by detecting the content when the image data is received from a device supplying the image data for the apparatus of FIG. 1. In the case where the received images for printing is not uniform and fluctuates the printing duty per each field, the value of n may be varied appropriately from field to field.

It should be noted that the present invention should not be specified to the embodiments set forth above but can be modified in various manners.

Namely, the numerical examples given in the foregoing embodiments should be understood as mere examples and can be used at appropriate values depending upon the construction of the apparatus and other conditions.

Also, while the foregoing embodiments have been discussed in the case where the recovery operation is performed upon initiation of printing and during printing operation, it is possible to perform recovering process, namely, a sequence of processes of positioning of the head at the home position, pressurizing recirculating process, wiping, washing or sucking of washing liquid and re-setting of the home position of the head, may be performed upon on-set of power supply for the apparatus.

Furthermore, it is also possible to initiate the recovery process by operation of a predetermined switch by the operator at an appropriate timing or in response to instruction by the apparatus.

In addition, it is possible to perform an appropriate recovery process depending upon the image data.

Sixth Embodiment

Figure 13:
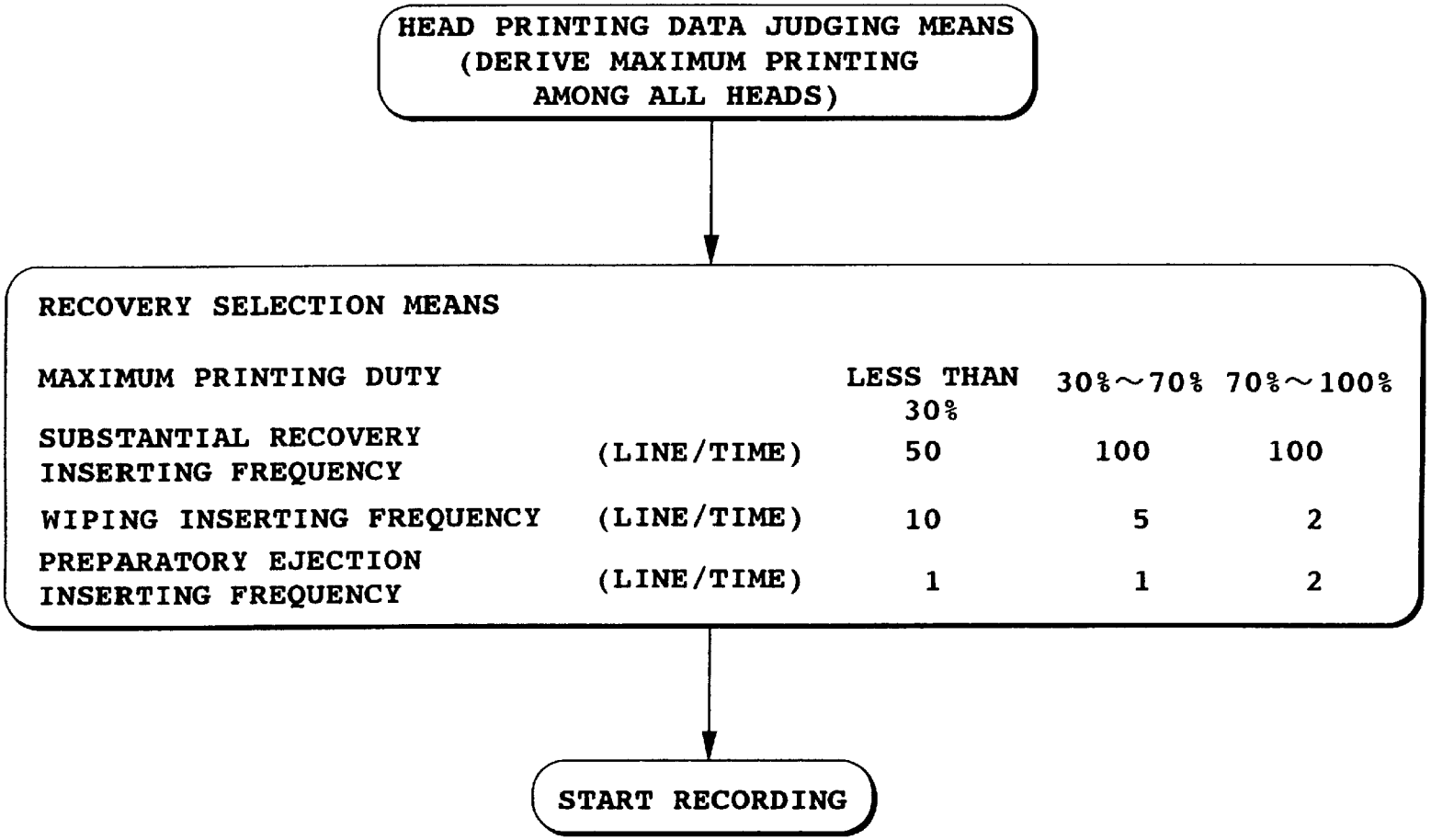
FIG. 13 is a flowchart showing the sixth embodiment of a printing sequence of the present invention.

As one example of recovery process depending upon the image data, FIG. 13 is an explanatory illustration of the embodiment for improving production speed by appropriately selecting the recovering means depending upon the image printing duty. Namely, in the shown embodiment, in advance of initiation of printing, a maximum printing duty of a printing head having the highest printing duty is derived from the image data, and depending on the maximum printing duty thus derived, the inserting frequencies of respective recovering process, i.e. substantial recovering process, preparatory ejecting process and the wiping process as set forth above, are determined. Here, substantial recovering process is a sequence of processes from the ink pressurizing recirculating operation to the wiping operation (both side wiping) (including capping operation) (corresponding to steps S1 to S5), the preparatory ejection means the process to perform simultaneous ejection through the ejecting orifice group in the condition where the printing head is opposed to the cap or the absorbing material.

As shown in FIG. 13, the wiping operation by the cleaning member 70 of the porous material is to be performed at higher frequency for the higher maximum printing duty to avoid occurrence of wet non-ejection. On the other hand, the substantial recovery process and the preparatory ejection is to be performed at higher frequency for lower maximum printing duty in order to maintain stable ejection from initiation of ejection for a long period.

Seventh Embodiment

Figure 14:
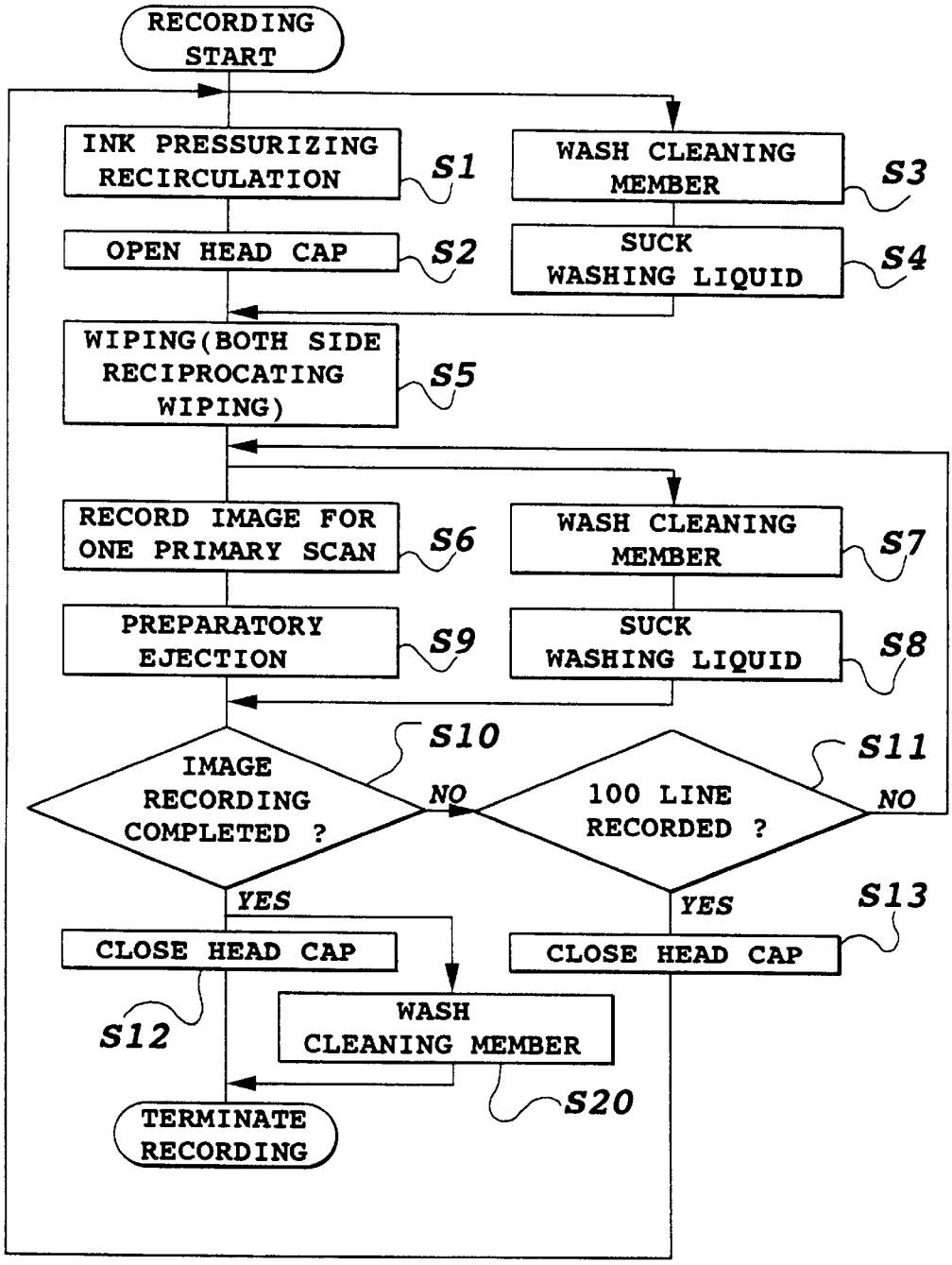
FIG. 14 is a flowchart showing the seventh embodiment of a printing sequence of the present invention.

When the printing operation is not performed after completion of image printing for a certain period, namely, ejecting operation and wiping operation are not performed for a long period, or the apparatus per se is held resting for a long period, the wiping means may be completely dried. If such condition is caused, operation (steps S3 and S4) of washing of the cleaning member and suction of the washing material upon next occasion of initiation of printing cannot be performed effectively resulting in failure of operation or ejection failure due to failure of cleaning of the ejecting surface of the head by wiping. Therefore, in the shown embodiment, as shown in FIG. 14, upon completion of image printing (when the answer at step S10 becomes positive), washing operation of the cleaning member 70 of sponge-like porous material (step 20) is performed allowing to wait for next occasion of printing in a condition where the cleaning member 70 is sufficiently wetted.

By this, after completion of printing, even at resumption of printing after 12 hours at 20° C. of temperature and 55% of humidity, the cleaning member was not dried out and excellent printing operation could be performed. In order to certainly prevent the cleaning member 70 from drying in non-use state for a long period, it is desirable to increase the content of the washing liquid during resting of printing head and to adjust the washing liquid content upon initiation of recording (printing). However, since it is difficult to certainly check how much amount of washing liquid is reduced during the resting state of the printing head, in the shown embodiment, the washing liquid is initially supplied for the cleaning member 70 to remove dust and so forth before initiation of recording (step S3) and thereafter sucked from the cleaning member 70 in the predetermined amount (step S4) to adjust the washing liquid content.

It should be noted that the present invention should not be limited to the foregoing embodiments but can be modified in various ways as exemplified below.

Figure 15:
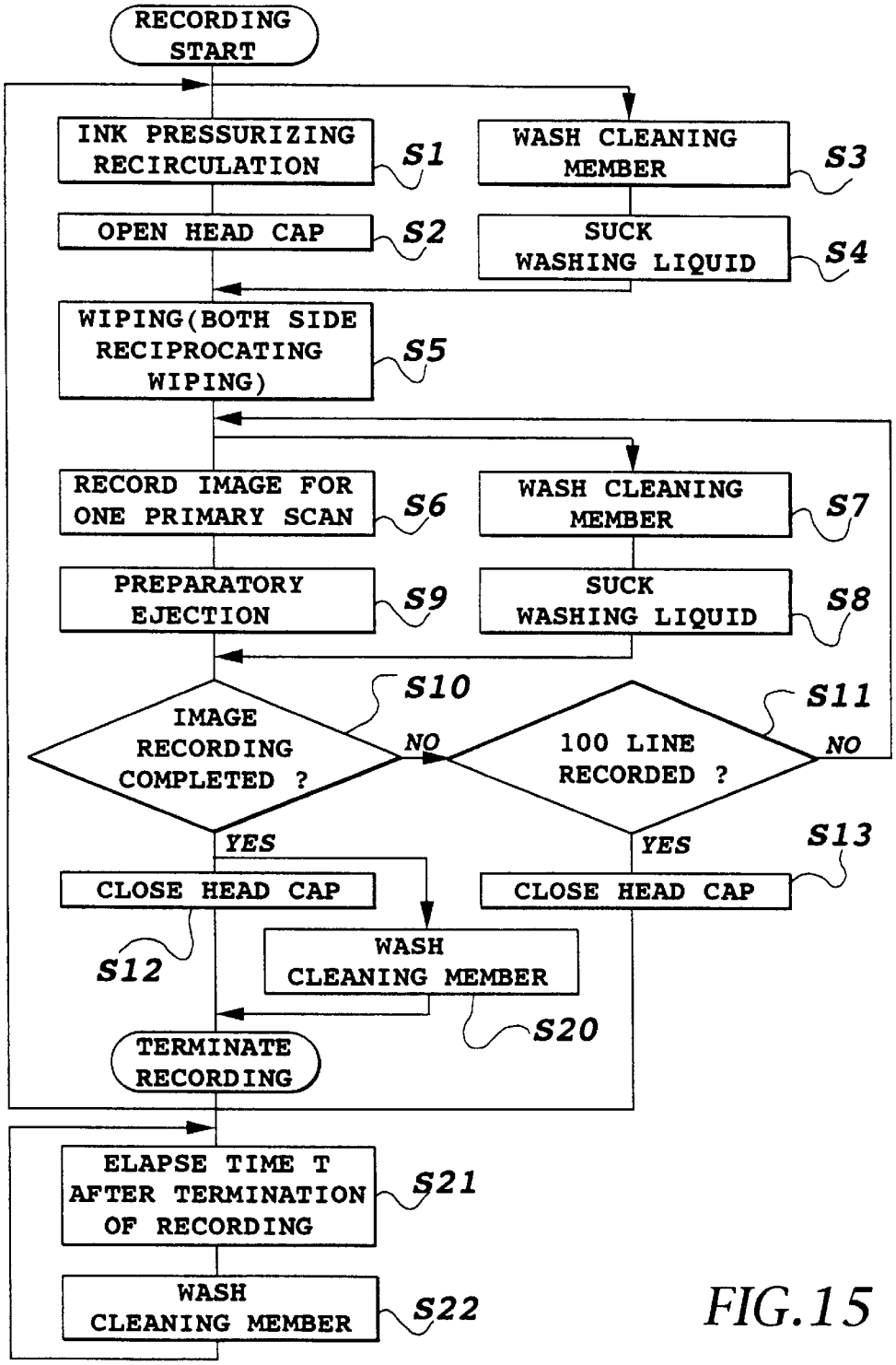
FIG. 15 is a flowchart showing the eighth embodiment of a printing sequence of the present invention.

FIG. 15 is a flowchart showing an operation sequence of the apparatus as illustrated in FIGS. 1 to 5 and 7. In the shown sequence, a process (steps S21 and S22) for washing the cleaning member 70 after elapsing of a predetermined period (e.g. 12 hours) after termination of printing is added for the sequence of FIG. 14 so that desired effect can be maintained for further longer period. It should be noted that when the timing can be set appropriately, step S20 in the shown sequence can be neglected.

On the other hand, as set forth above, instead of performing washing process for the cleaning member 70 upon termination of printing and/or at a predetermined timing after termination of printing, an appropriate means for preventing the cleaning member from drying can be provided.

Figure 16A:
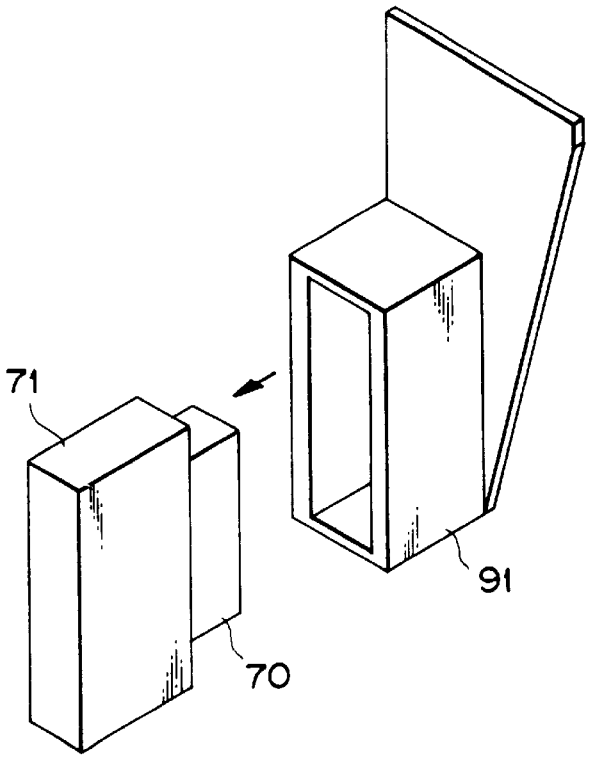
FIGS. 16A and 16B are explanatory perspective views showing construction and operation of an anti-drying means employed in the eighth embodiment of the present invention.
Figure 16B:
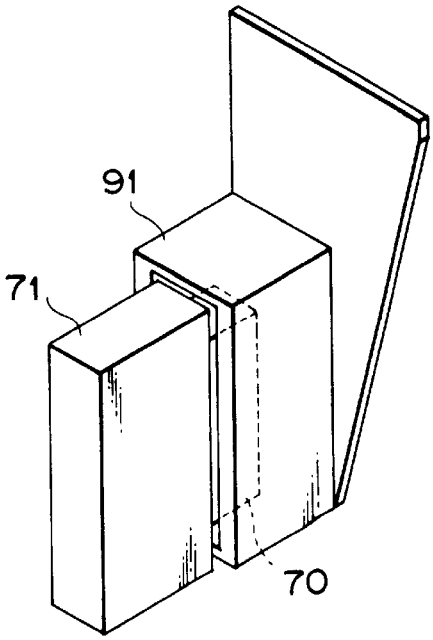

FIG. 16 shows one example of a construction of a means for preventing the cleaning member from drying. In the shown example, a cap member 91 (hereinafter referred to as "blade cap") movable relative to the wiping blade form cleaning member 70 or mountable thereto is provided. Upon initiation of the printing operation, the blade cap is retracted at a position away from the cleaning member 70 so as not to interfere movement of the head 2 or so forth, or is removed. On the other hand, upon termination of printing, an enclosed state of the wiping blade 70 illustrated in FIG. 16B is established from a state illustrated in FIG. 16A to prevent the cleaning member 70 from drying.

Moreover, for the construction set forth above, it is possible to add an appropriate means for avoiding failure in retracting or removing the blade cap 91 upon resumption of printing.

Figure 17:
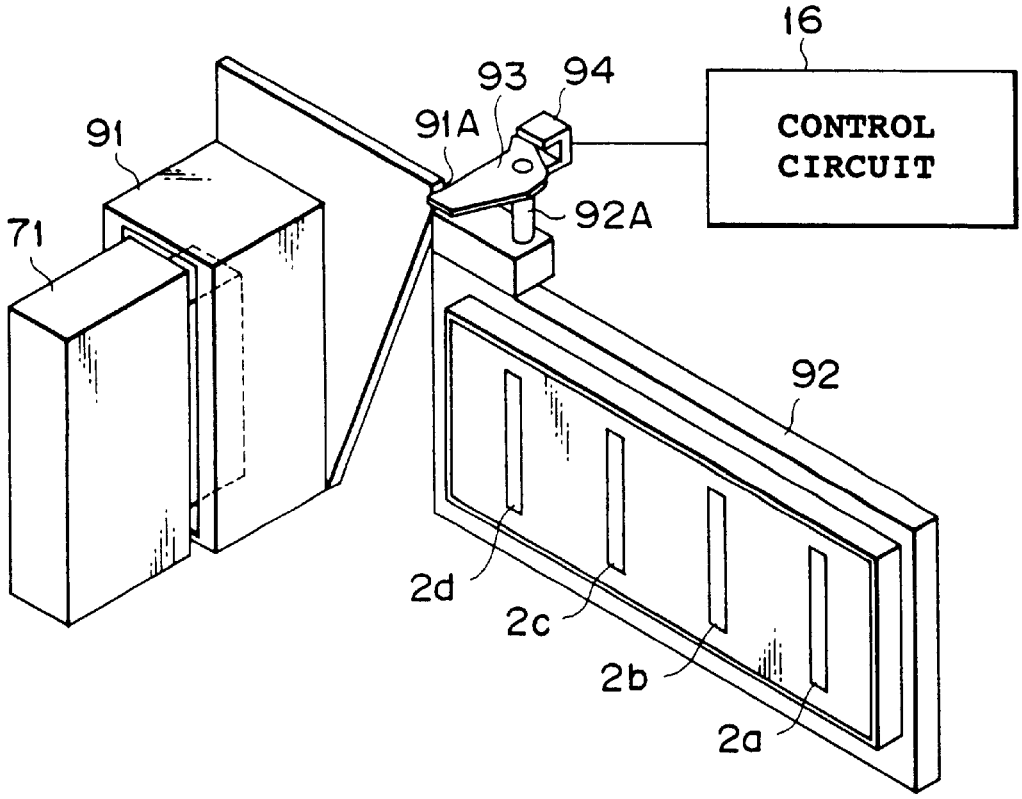
FIG. 17 is an explanatory perspective view for showing construction and operation of a detecting means employed in the eighth embodiment of the invention.

FIG. 17 shows an example of a construction for the means for avoiding failure in retracting or removing the blade cap 91 upon resumption of printing. Here, 92 denotes a holder for holding respective colors of heads 2*a* to 2*d*. 93 is a lever held on a shaft 92*a* projecting from the holder 92. The lever 93 has an arm portion engageable with a contacting portion 91A of the blade cap 91 and an arm portion which can block a light axis of a photo-interrupter 94 connected to the control circuit 16. The lever 93 is biased in a direction for blocking the light axis of the photo-interrupter by means of a spring or so forth.

Figure 18:
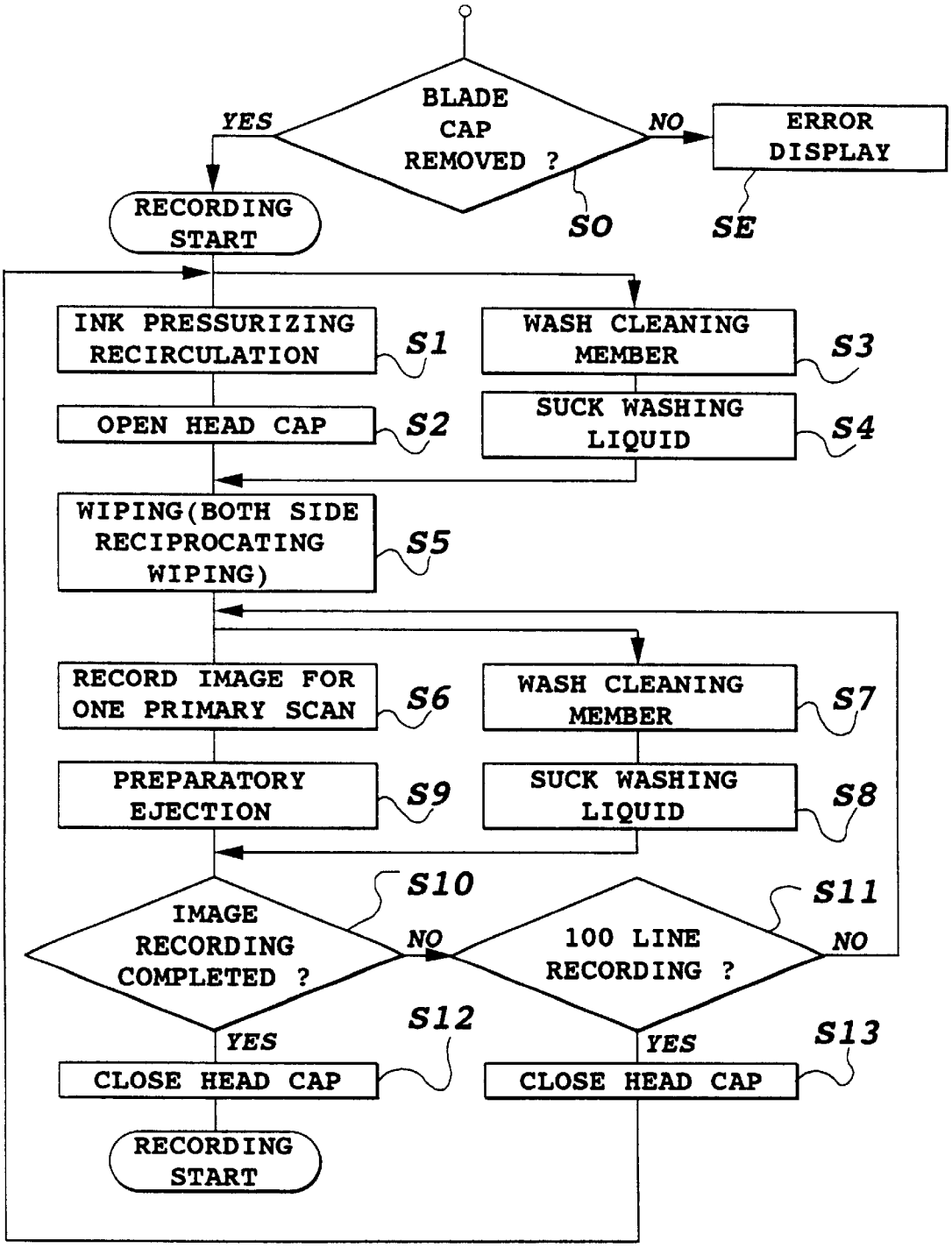
FIG. 18 is a flowchart showing a printing sequence of a ninth embodiment of the invention.

FIG. 18 is a flowchart showing one example of the operation sequence in the case where the construction shown in FIG. 17 is employed. In the shown sequence, with respect to the operation sequence of FIG. 14, step S20 is neglected and step 50 for detecting removal or retraction of the blade cap by means of the detecting means of the lever 93 and the photo-interrupter 94 upon initiation of printing is added. Namely, when the blade cap 91 is not fitted to the cleaning member, the light axis of the photo-interrupter is held on to perform printing under the control of the control circuit 16. On the other hand, when the blade cap 91 is fitted, since the light axis of the photo-interrupter becomes off, the control circuit 16 require removal or retracting of the blade cap 91 by performing predetermined error display or so forth (step SE).

It should be noted that in the procedure of FIG. 18, it is possible to perform the process for tightly fitting the head cap (step S12) and in conjunction therewith to perform fitting of the blade cap to the cleaning member 70 upon termination of the printing operation. Also, in the case where the blade cap is manually fitted and removed, fitting of the blade cap may be prompted.

It should be noted that, the foregoing embodiments may be employed in combination.

The present invention achieves distinct effect when applied to a printing head or a printing apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording bead as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 561847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Next, in the case that the present invention is applied to textile printing, the following performatory characteristics are required for the textile suitable for the ink jet textile printing:

(1) Colors should come out on ink in a sufficient density.
(2) Dye fixation factor is high for ink.
(3) Ink must be dried quickly.
(4) The generation of irregular ink spread is limited.
(5) Feeding can be conducted in an excellent condition in an apparatus.

In order to satisfy these requirements, it may be possible to give a preparatory treatment to the textile used for printing as required. In this respect, the textile having an in receptacle layer is disclosed in Japanese Patent Application Laying-open No. 62-53492, for example. Also, in Japanese Patent Application Publication No. 3-46589, there are proposed the textile which contains reduction preventive agents or alkaline substances. As an example of such preparatory treatment as this, it is also possible to name a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tori-ethanol amine, and other amines; and carbonate or hydrogen carbonate alkali metallic salt such as sodium carbonate, potassium carbonate, and sodium hydrogen carbonate. Furthermore, there are organic acid metallic salt such as calcium carbonate, barium carbonate or ammonia and ammonia compounds. Also, there can be used the sodium trichloroacetic acid and the like which become an alkaline substance by steaming and hot air treatment. For the alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxy ethel cellulose; polysaccharide such as sodium alginic acid, gum arabic, locasweet bean gum, tragacanth gum, guar gum, and tamarind seed; protein substances such as gelatin and casein; and natural water soluble polymer such as tannin and lignin.

Also, as a synthetic polymer, there can be named, for example, polyvinyl alcoholic compounds, polyethylene oxide compounds, acrylic acid water soluble polymer, maleic anhydride water soluble polymer, and the like. Among them, polysaccharide polymer and cellulose polymer should be preferable.

As a water soluble metallic salt, there can be named the pH4 to 10 compounds which produce typical ionic crystals, namely, halogenoid compounds of alkaline metals or alkaline earth metals, for example. As a typical example of these compounds, NaCl, $Na_2SO_4$, KCl and $CH_3$ COONa and the like can be named for the alkaline metals, for example. Also, $CaCl_2$, $MgCl_2$, and the like can be named for the alkaline earth metals. Particularly, salt such as Na, K and Ca should be preferable.

In the preparatory process, a method is not necessarily confined in order to enable the above-mentioned substances and others to be contained in the textile. Usually, however, a dipping method, padding method, coating method, spraying method, and others can be used.

Moreover, since the printing ink used for the ink jet textile printing merely remains to adhere to the textile when printed, it is preferable to perform a subsequent reactive fixation process (dye fixation process) or the dyestuff to be fixed on the textile. A reactive fixation process such as this can be a method publicly known in the art. There can be named a steaming method, HT steaming method, and thermofixing method, for example. Also, alkaline pad steaming method, alkaline blotch steaming method, alkaline shock method, alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. The methods of machine stitch the textile to make clothes and other daily needs are disclosed widely in publicly known publication such as "Summer dress you want to make" published on Jun. 10, 1987 by Kabushiki Kaisha Yukeisha.

In addition, the present invention is effectively applicable to a replaceable chip type printing head which is connected electrically with the main apparatus and can be supplied with ink when it is mounted in the main assemble, or to a cartridge type printing head having an integral ink container.

Furthermore, as a printing mode for the printing apparatus, it is not only possible to arrange a monochromatic mode mainly with black, but also it may be possible to arrange an apparatus having at least one of multi-color mode with different color ink materials and/or a full-color mode using the mixture of the colors irrespective of the printing heads which are integrally formed as one unit or as a combination of plural printing heads. The present invention is extremely effective for such an apparatus as this.

Now, in the embodiments according to the present invention set forth above, while the ink has been described as liquid, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with printing signals, an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus such as a word processor and a computer.

Further, as a medium to be printed, cloth, wall cloth, embroidery yarn, wall paper, paper, OHP film and so on can be named. Cloth can include all fabrics, nonwoven fabric and other textile materials irrespective of their materials and method of weaving or knitting therefor.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. A recording apparatus for performing recording on a recording medium by ejecting a predetermined liquid employing a liquid ejection head, comprising:

wiping means for wiping a surface of said liquid ejection head through which the liquid is ejected; and means for varying a wiping condition of said surface of said liquid ejection head by said wiping means;

penetration amount control means for controlling a penetration amount of said wiping means into said liquid ejection head, wherein said liquid ejection head is reciprocated, and said means for varying the wiping condition varies a wiping direction relative to said liquid ejection head so that said wiping means wipes said surface of said liquid ejection head in only a predetermined direction during a recording operation and in reciprocating directions before the recording operation;

recovery means for maintaining a good ejection condition of said liquid ejection head, said recovery means including means for performing a process employing said wiping means, means for performing a process employing said wiping means and pressurizing an ink supply system, and means for performing ejection of ink through said liquid ejection head for other than printing; and means for varying processing conditions of said recovery means for performing processes depending upon an image data.

2. A recording apparatus for performing recording on a recording medium by ejecting a predetermined liquid employing a liquid ejection head, comprising:

wiping means for wiping a surface of said liquid ejection head through which the liquid is ejected; and means for varying a wiping condition of said surface of said liquid ejection head by said wiping means, wherein said wiping condition to be varied is a relative wiping speed between said wiping means and said liquid ejection head, and the relative wiping speed before a recording operation is lower than during the recording operation.

3. A recording apparatus for performing recording by ejecting a predetermined liquid employing a liquid ejection head, comprising:

wiping means for wiping a surface of said liquid ejection head through which the liquid is ejected, said wiping means including a porous material blade;

cleaning means for cleaning said wiping means, said cleaning means including liquid ejecting means for ejecting a washing liquid to said wiping means; and means for varying a wiping condition of said surface of said liquid ejection head by said wiping means, wherein said wiping condition to be varied is a content of a washing liquid of said wiping means, and the content of the washing liquid is greater before the recording operation than during the recording operation.

4. A recording apparatus for performing recording on a recording medium by ejecting a predetermined liquid employing a liquid ejection head, comprising:

wiping means for wiping a surface of said liquid ejection head through which the liquid is ejected; and means for varying a wiping condition of said surface of said liquid ejection head by said wiping means, wherein said wiping condition to be varied is a frequency of contact of said wiping means and said liquid ejecting surface, and the frequency of contact before a recording operation is higher than during the recording operation.

5. A recording apparatus as claimed in claim 1, which further comprises means for varying said wiping condition during operation of said recording apparatus.

6. A recording apparatus as set forth in claims 1, 2, 3 or 4, wherein said liquid ejection head has an element for generating thermal energy as energy to be used for ejecting said liquid.

7. A recording apparatus as set forth in claims 2, 3 or 4, further comprising:

recovery means for maintaining a good ejection condition of said liquid ejection head, said recovery means including means for performing a process employing said wiping means, means for performing a process employing said wiping means and pressurizing an ink supply system, and means for performing ejection of ink through said liquid ejection head for other than printing; and means for varying processing conditions of said recovery means for performing processes depending upon an image data.

8. A liquid ejecting apparatus for ejecting a predetermined liquid employing a liquid ejection head, comprising:

wiping means for wiping a surface of said liquid ejection head through which the liquid is ejected, said wiping means including a porous material blade; and means for varying a wiping condition of said surface of said liquid ejection head by said wiping means, wherein said liquid ejection head is reciprocated, and the wiping condition to be varied is a penetration amount of said wiping means into said liquid ejection head, wherein said penetration amount before the recording operation of said liquid ejecting apparatus is greater than that upon recording.

9. A recording apparatus as claimed in claim 4, wherein said cleaning means includes liquid sucking means for sucking liquid from said wiping means.

10. A recording apparatus as set forth in claim 9, wherein said liquid ejection head is reciprocated, and said wiping condition to be varied is a content of a washing liquid of said wiping means.

11. A recording apparatus as claimed in claim 3, wherein said liquid ejection head is reciprocated, and said means for varying the wiping condition varies wiping direction relative to said liquid ejection head.

12. A recording apparatus as claimed in claim 3, wherein said liquid ejection head is reciprocated and said means for varying the wiping condition varies a relative wiping speed between said wiping means and said liquid ejection head.

13. A recording apparatus as set forth in claim 3, wherein said liquid ejection head is reciprocated, and said wiping condition to be varied is frequency of contact of said wiping means and said liquid ejecting surface.

14. A liquid ejecting apparatus for ejecting a predetermined liquid employing a liquid ejection head comprising:

wiping means for wiping a surface of said liquid ejection head through which said liquid is ejected;

cleaning means for cleaning said wiping means by providing washing liquid for said wiping means; and drying preventing means for preventing said wiping means from drying, wherein said drying preventing means has means for enclosing said wiping means.

15. A liquid ejecting apparatus as set forth in claim 14, wherein said drying preventing means makes said cleaning means to provide a washing liquid to said wiping means after termination of ejection by said liquid ejection head.

16. A liquid ejecting apparatus as set forth in claim 14, wherein said drying preventing means makes said cleaning means to provide a washing liquid to said wiping means at a predetermined timing after termination of ejection by said liquid ejection head.

17. A liquid ejecting apparatus as set forth in claim 14, wherein said wiping means includes a sponge-like porous material.

18. A liquid ejecting apparatus as set forth in claim 17, which further comprises means for adjusting a water content in said sponge-like porous material before initiation of recording.

19. A liquid ejecting apparatus as set forth in claim 18, wherein the water content to be adjusted before initiation of recording is smaller than the water content of said sponge-line porous material after termination of recording.

20. A liquid ejecting apparatus as set forth in claim 18, wherein said water content adjusting means comprises means for providing washing liquid to said sponge-like porous material and means for sucking a predetermined amount of the washing liquid from said sponge-line porous material.

21. A liquid ejecting apparatus as set forth in claim 15, which further comprises means for detecting presence and absence of said enclosing means for said wiping means in advance of liquid ejecting operation.

22. A liquid ejecting apparatus as set forth in claim 14, wherein said liquid ejection head has an element for generating thermal energy as energy to be used for ejecting said liquid.

23. A liquid ejecting apparatus for ejecting a liquid employing a liquid ejection head, comprising:

wiping means for wiping a surface of said liquid ejection head through which the liquid is ejected, said wiping means including a porous material blade, and wiping being performed by a relative movement between said blade and said liquid ejection head; and control means for varying a wiping condition when wiping said surface of said liquid ejection head by said wiping means, the wiping condition differing depending upon whether wiping is performed before a liquid ejecting operation of said liquid election head or whether wiping is performed at a predetermined timing between ejecting operations of said liquid ejection head.

24. A liquid ejecting apparatus according to claim 23, wherein said control means controls a relative wiping speed between said blade and said liquid ejection head.

25. A liquid ejecting apparatus according to claim 23, further comprising:

cleaning means for cleaning said porous material blade of said wiping means using a washing liquid, wherein said control means controls an amount of a washing liquid contained in said porous material blade during wiping by said wiping means.

26. A liquid ejecting apparatus according to claim 25, wherein said cleaning means includes liquid sucking means for sucking liquid from said porous material blade.

27. A liquid ejecting apparatus according to claim 23, further comprising:

moving means for moving said wiping means towards said liquid ejection head so as to vary a penetration amount of said blade into said surface of said liquid ejection head, wherein said control means controls said moving means to move said wiping means and controls a penetration amount of said blade into said surface of said liquid ejection head.

28. A liquid ejecting apparatus according to claim 23, wherein said control means controls a frequency of contact between said wiping means and said surface of said liquid ejection head.

29. A liquid ejecting apparatus according to claim 28, further comprising:

scanning means for scanning said liquid ejection head in reciprocating directions, wherein said wiping means wipes said surface of said liquid ejection head when said liquid ejection head is scanned by said scanning means and control means controls wiping of said surface of said liquid ejection head so that wiping is performed when said liquid ejection head is scanned in only a predetermined direction or when said liquid ejection head is scanned in reciprocating directions by said scanning means.

30. A liquid ejecting apparatus according to claim 23, comprising:

recovery means for maintaining good ejecting condition of said liquid ejection head;

first means for performing a first process employing said wiping means;

second means for performing a second process employing said wiping means and pressurizing an ink supply system;

third means for performing ejection of ink through said liquid ejection head for other than printing; and means for varying processing conditions of the first means, second means, and third means depending upon an image data.

31. A liquid ejection apparatus according to claim 23, wherein said liquid ejection head has an element for generating thermal energy used for ejecting said liquid.

32. An ink jet recording apparatus for recording by ejecting an ink employing an ink jet recording head, comprising:

wiping means for wiping a surface of said recording head through which the ink is ejected, said wiping means including a porous material blade, wiping being performed by a relative movement between said blade and said recording head; and recovery control means for controlling said wiping means to carry out wiping at a predetermined timing and for recovering said recording head to an ejecting condition, wherein said recovery control means varies a condition of said wiping means during a period between a recording operation of ejecting the ink from said ink jet recording head and non-performance of said recording operation, the wiping condition differing depending upon whether wiping is performed before a recording operation of said recording head or whether wiping is performed at a predetermined timing between recording operations of said recording head.

33. An ink jet recording apparatus according to claim 32, wherein said recording head has an element for generating thermal energy used for ejecting said ink.

34. An ink jet recording apparatus according to claim 32, further comprising cleaning means for cleaning said porous material blade of said wiping means using a washing liquid, wherein said control means controls an amount of a washing liquid contained in said porous material blade during wiping by said wiping means.

35. An ink jet recording apparatus according to claim 34, wherein said cleaning means includes liquid sucking means for sucking liquid from said porous material blade.

* * * * *

UNITED STATES PATENT AND TRADEMARK OFFICE

CERTIFICATE OF CORRECTION

PATENT NO. : 6,206,497 B1
DATED : March 27, 2001
INVENTOR(S) : Miura et al.

It is certified that error appears in the above-identified patent and that said Letters Patent is hereby corrected as shown below:

Title page,
U.S. PATENT DOCUMENTS, "4,313,124" should read -- 4,323,124 --.
FOREIGN PATENT DOCUMENTS, "03046589" should read -- 3-46589 --; and "59-138461 7/1984 (JP)." should read -- 59-138461 8/1984 (JP). --.

Column 2,
Line 32, "enjoying" should read -- employing --.

Column 6,
Line 21, "are a few possibility" should read -- is the possibility --;
Line 22, "residual of bubble" should read -- residual bubbles --; and "to border" should read -- to approach borderline --; and
Line 50, "humidity" should read -- there is humidity --.

Column 9,
Line 6, "affect for effect of" should read -- affect --.

Column 15,
Line 30, "561847/1979" should read -- 56847/1979 --;
Line 52, "in" should read -- ink --; and
Line 55, "are" should read -- is --.

Column 17,
Line 2, "assemble," should read -- assembly, --.

Column 18,
Line 56, "claim 1," should read -- claims 1, 2, 3 or 4, --.

UNITED STATES PATENT AND TRADEMARK OFFICE

CERTIFICATE OF CORRECTION

PATENT NO. : 6,206,497 B1
DATED : March 27, 2001
INVENTOR(S) : Miura et al.

It is certified that error appears in the above-identified patent and that said Letters Patent is hereby corrected as shown below:

Column 19,
Line 24, "claim 4," should read -- claim 3, --.

Column 20,
Line 4, "line" should read -- like --; and
Line 11, "claim 15," should read -- claim 14, --.

Signed and Sealed this

Sixteenth Day of April, 2002

*Attest:*

*Attesting Officer*

JAMES E. ROGAN
*Director of the United States Patent and Trademark Office*